US011340552B2

(12) United States Patent
Ishihara

(10) Patent No.: US 11,340,552 B2
(45) Date of Patent: May 24, 2022

(54) IMAGE FORMING APPARATUS

(71) Applicant: CANON KABUSHIKI KAISHA, Tokyo (JP)

(72) Inventor: Shotaro Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/322,619

(22) Filed: May 17, 2021

(65) Prior Publication Data

US 2021/0364977 A1 Nov. 25, 2021

(30) Foreign Application Priority Data

May 20, 2020 (JP) ..... JP2020-087778

(51) Int. Cl.
*G03G 21/16* (2006.01)
*G03G 21/00* (2006.01)
*G03G 15/00* (2006.01)

(52) U.S. Cl.
CPC ..... *G03G 21/1619* (2013.01); *G03G 15/50* (2013.01); *G03G 21/0005* (2013.01)

(58) Field of Classification Search
CPC ..... G03G 21/1619; G03G 15/50; G03G 21/0005; G03G 15/5037; G03G 15/80
See application file for complete search history.

(56) References Cited

U.S. PATENT DOCUMENTS 6,285,385 B1 * 9/2001 Owaki ..... G03G 15/5037 347/132
2012/0051763 A1 * 3/2012 Ariizumi ..... G03G 15/5037 399/31
2015/0063863 A1 * 3/2015 Koyanagi ..... G03G 21/1619 399/107
2016/0109848 A1 * 4/2016 Ohata ..... G03G 21/1619 399/107

FOREIGN PATENT DOCUMENTS

JP 2017049498 A 3/2017

* cited by examiner

*Primary Examiner* — Sandra Brase
(74) *Attorney, Agent, or Firm* — Canon U.S.A., Inc. I.P. Division

(57) ABSTRACT

An image forming apparatus includes a rotatable photosensitive member, a charging unit, a developing unit, a support frame, and a sensor unit. The sensor unit is detachably attached to the support frame in a direction that intersects a rotation-axis direction of the photosensitive member and includes a potential sensor, a support portion, a fixing portion, an electric board, and a linking portion. The support portion supports the potential sensor at an area from the charging unit to the developing unit in a rotational direction of the photosensitive member. The fixing portion is fixed to the support frame at a position that faces an area from the developing unit to the charging unit in the rotational direction of the photosensitive member. The support portion is positioned with respect to the support frame at a position downstream of the support portion in an attachment direction of the sensor unit.

8 Claims, 14 Drawing Sheets

IMAGE FORMING APPARATUS

BACKGROUND

Field of the Disclosure

The present disclosure relates to image forming apparatuses such as copying machines, printers, facsimiles, and multifunction printers having a plurality of functions of these products.

Description of the Related Art

An image forming apparatus that forms an image by using electrophotography causes a charging apparatus to charge a surface of a photosensitive member (photosensitive drum), then forms an electrostatic latent image by exposing the surface of the photosensitive member, and then causes a developing apparatus to develop the electrostatic latent image into a toner image. Then the image forming apparatus transfers the toner image onto a recording medium such as a paper sheet, and forms an image by fixing the toner image to the recording medium. For charging the photosensitive member, a scorotron charger that uses a wire and a grid is often used, in particular in an image forming apparatus designed so as to operate faster and produce high quality images. Unlike contact chargers that use a rubber roller, the scorotron charger detects a charge potential of the surface of the photosensitive member for controlling the attenuation of potential of the surface of the photosensitive member. Japanese Patent Application Publication No. 2017-49498 proposes an image forming apparatus including a potential sensor that measures a surface potential of the photosensitive member. The potential sensor is disposed downstream of the charger and upstream of the developing apparatus in a moving direction of the charged photosensitive member (image bearing member).

Such a potential sensor is fixed to a support frame of the image forming apparatus, separately from the photosensitive member that is also fixed to the support frame. The image forming apparatus also includes an electric board that adjusts a potential detected by the potential sensor. Since the electric board has an area larger than that of the potential sensor, it is difficult to dispose the electric board in the vicinity of a position at which the potential sensor is fixed to the support frame. Thus, the electric board is disposed such that the photosensitive member and a cleaning portion for the photosensitive member are disposed between the potential sensor and the electric board. For example, the electric board is fixed to a side plate of an apparatus body disposed opposite to the potential sensor with respect to the photosensitive member. Note that if the potential sensor or the electric board needs to be replaced for failure in assembly in a factory or after installation in a user site, it is necessary to replace both of the potential sensor and the electric board.

However, in the image forming apparatus described in Japanese Patent Application Publication No. 2017-49498, the potential sensor is disposed between the charger and the developing apparatus, and the electric board is disposed opposite to the potential sensor with respect to the photosensitive member. Thus, even if the potential sensor and the electric board are integrated into a unit for easily replacing the potential sensor and the electric board, the potential sensor remains to be positioned separated from the electric board. In this configuration, the unit is fixed to the side plate of the apparatus body, causing the distance between the side plate and the potential sensor to be long. In addition, the potential sensor is in a state in which the potential sensor is supported by a cantilever that extends from the side plate of the apparatus body. As a result, the positional accuracy of the potential sensor may deteriorate, thus deteriorating the measurement accuracy on the charge potential of the surface of the photosensitive member. The deterioration on the measurement accuracy may cause image defects.

SUMMARY

According to a first aspect of the present disclosure, an image forming apparatus includes a rotatable photosensitive member, a charging unit configured to charge the photosensitive member, a developing unit configured to develop an electrostatic latent image formed on the photosensitive member by using toner, a support frame supporting the photosensitive member, and a sensor unit detachably attached to the support frame in a direction that intersects a rotation-axis direction of the photosensitive member and including a potential sensor configured to measure a potential of the photosensitive member, a support portion supporting the potential sensor at an area from the charging unit to the developing unit in a rotational direction of the photosensitive member, a fixing portion fixed to the support frame at a position that faces a part of an area from the developing unit to the charging unit in the rotational direction of the photosensitive member, an electric board connected to the potential sensor and fixed to the fixing portion, and a linking portion linking the support portion and the fixing portion. The support portion is positioned with respect to the support frame at a position downstream of the support portion in an attachment direction of the sensor unit.

Further features of the present disclosure will become apparent from the following description of exemplary embodiments with reference to the attached drawings.

DESCRIPTION OF THE EMBODIMENTS

First Embodiment

Hereinafter, a first embodiment of the present disclosure will be described in detail with reference to FIGS. 1 to 8. In the present embodiment, the description will be made for a tandem-type full-color printer, which is one example of an image forming apparatus 1. However, the present disclosure is not limited to the tandem-type image forming apparatus 1, and may be applied to other types of the image forming apparatus. In addition, the present disclosure is not limited to full-color printers, and may be applied to monochrome or monocolor printers. Note that in the present embodiment, as illustrated in each figure, the front side of the image forming apparatus 1 is defined as a front direction F, the back (rear) side is defined as a back direction B, the left side is defined as the left direction L, the right side is defined as a right direction R, the upper side is defined as an upward direction U, and the lower side is defined as a downward direction D.

Image Forming Apparatus

Figure 1:
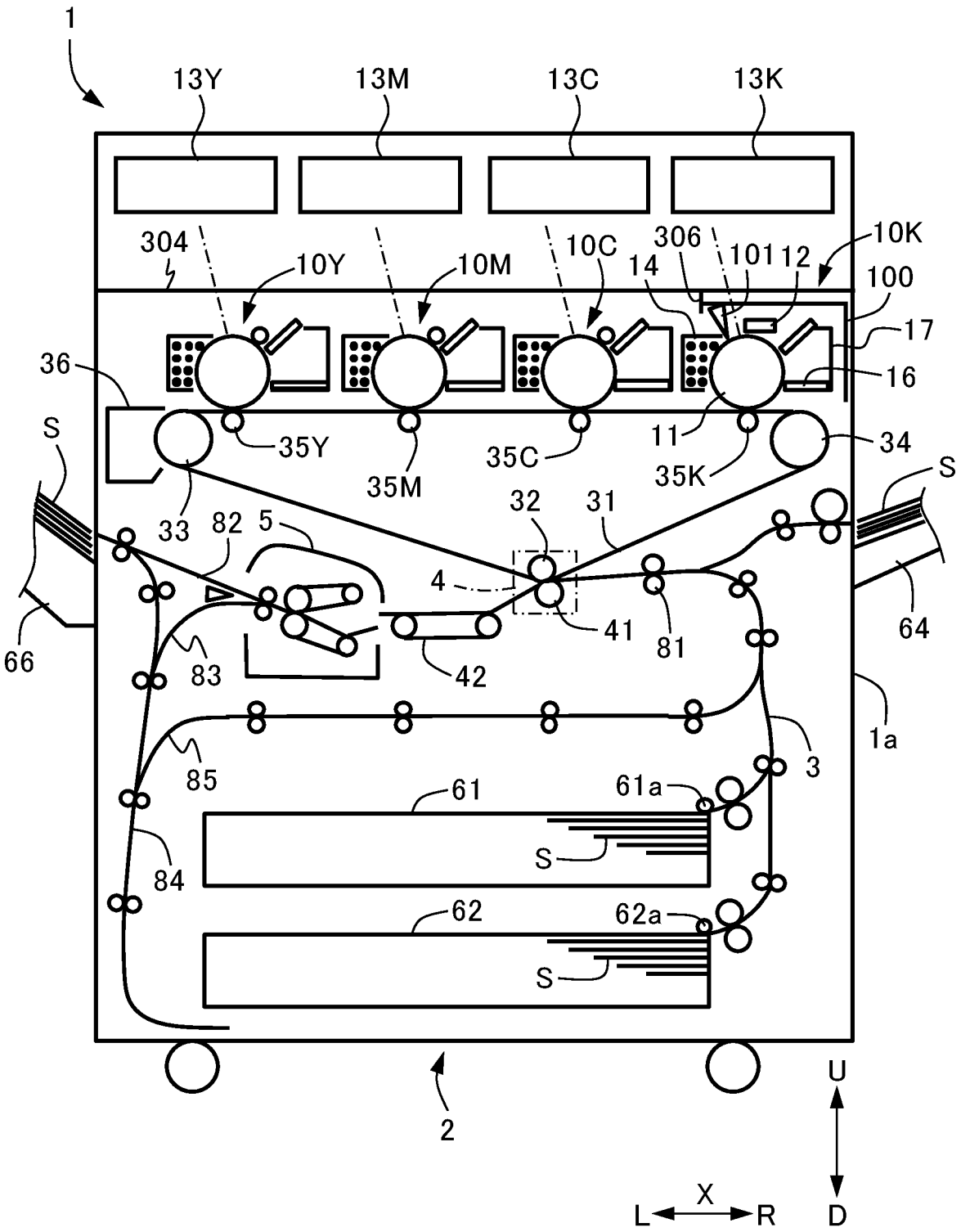
FIG. 1 is a cross-sectional view illustrating an image forming apparatus of a first embodiment.

The image forming apparatus 1 illustrated in FIG. 1 is an electrophotographic full-color printer that includes four drum cartridges 10Y, 10M, 10C, and 10K, disposed in an apparatus body and corresponding to four colors (yellow, magenta, cyan, and black). In the present embodiment, the image forming apparatus 1 is a tandem-type intermediate-transfer system in which the drum cartridges 10Y, 10M, 10C, and 10K are disposed along a rotational direction of a later-described intermediate transfer belt 31. The image forming apparatus 1 forms a toner image (image) on a sheet (recording material) S, in accordance with an image signal sent from a document reading apparatus (not illustrate) connected to the apparatus body, or from a host device, such as a personal computer, communicatively connected to the apparatus body. The sheet S may be a sheet material, such as a paper sheet, a plastic film, or a cloth sheet.

Next, a feeding process in which the sheet S is fed to a secondary transfer portion 4 by a sheet feeding portion 2 will be described. The sheet S is stored in a feeding cassette 61 or 62 disposed in a lower portion of the image forming apparatus 1, and fed from the feeding cassette 61 or 62 by a feed roller 61*a* or 62*a*. The sheet S fed by the feed roller 61*a* or 62*a* is separated one by one in a separation portion, and conveyed to a registration roller pair 81 through a conveyance path 3. The registration roller pair 81 is disposed upstream of the secondary transfer portion 4 in the sheet conveyance direction (hereinafter, referred simply as to upstream). The registration roller pair 81 corrects skew of the sheet S, and conveys the sheet S to the secondary transfer portion 4 at a predetermined timing. Similarly, a sheet S fed from a manual feeding tray 64 is also conveyed to the registration roller pair 81, and the registration roller pair 81 corrects skew of the sheet S and conveys the sheet S to the secondary transfer portion 4 at a predetermined timing.

Image Forming Portion

The drum cartridges 10Y, 10M, 10C, and 10K have substantially the same configuration, except that their toner colors, yellow, magenta, cyan, and black, are different from each other. Thus, in the following description, the drum cartridge 10K of black will be described as an example, and the description for the other drum cartridges 10Y, 10M, and 10C will be omitted. A sensor unit 100 is disposed around the drum cartridge 10K. The sensor unit 100 will be described later.

A photosensitive drum 11 is one example of the photosensitive member, and the surface of the photosensitive drum 11 is uniformly charged by a charging unit 12. Laser scanners 13Y, 13M, 13C, and 13K respectively receive image signals for yellow, magenta, cyan, and black. Each of the laser scanners emits a laser beam to the surface of a corresponding photosensitive drum, neutralizes the electric charge, and forms an electrostatic latent image. A front portion and a back portion of the photosensitive drum 11 are supported by a frame 18 (see FIG. 3), and the photosensitive drum 11 is integrated with the drum cartridge 10.

The electrostatic latent image formed on the photosensitive drum 11 is developed by a developing apparatus 14, with toner of yellow, magenta, cyan, or black. Toner images formed through the development on the photosensitive drums of the drum cartridges 10Y, 10M, 10C, and 10K are sequentially transferred onto an endless intermediate transfer belt 31 by primary transfer rollers 35Y, 35M, 35C, and 35K. The transferred toner images form a full-color toner image on the intermediate transfer belt 31. After the toner images are transferred onto the intermediate transfer belt 31, the electric charge of the photosensitive drum 11 is removed by an electricity-removal-and-exposure portion 16, and the toner (primary-transfer residual toner) having not been used for the transfer onto the intermediate transfer belt 31 is scraped from the photosensitive drum 11 by a cleaning unit 17. The toner scraped from the photosensitive drum 11 is stored, as toner having been removed, in a toner collection box by a toner collection-and-conveyance portion (not illustrated).

The intermediate transfer belt 31 bears the primary-transferred full-color toner image, and conveys the full-color toner image to the secondary transfer portion 4 at a timing at which the sheet S is conveyed to the secondary transfer portion 4 in the sheet conveyance process. The intermediate transfer belt 31 is stretched by and wound around a driving roller 33, a tension roller 34, and a secondary transfer inner roller 32, and is rotated by the rotation of the driving roller 33. The toner left on the intermediate transfer belt 31 is removed by a transfer cleaning unit 36.

Next, a secondary transfer process performed by the secondary transfer portion 4 and processes performed after the secondary transfer process will be described. The secondary transfer portion 4 includes the secondary transfer inner roller 32, and a secondary transfer outer roller 41 that faces the secondary transfer inner roller 32. The secondary transfer portion 4 secondary-transfers the full-color toner image onto the sheet S in a nip portion between the secondary transfer inner roller 32 and the secondary transfer outer roller 41, by applying a predetermined pressure and electrostatic load bias to the sheet S. After the full-color toner image is secondary-transferred onto the sheet S in the secondary transfer portion 4, the sheet S is conveyed to the fixing portion 5 by a sheet conveyance apparatus 42.

In the fixing portion 5, the sheet S is nipped by rollers that face each other, or by a belt and a roller that face each other, and applied with a predetermined amount of heat and pressure. The heat is applied by a heat source such as a heater. With this operation, the toner image having been secondary-transferred onto the sheet S melts, solidifies, and fixes to the sheet S. The sheet S to which the toner image has fixed is discharged to a discharging tray 66 through a discharge-and-conveyance path 82. If images are to be formed on both sides of the sheet S, the sheet S is conveyed to a reversing path 83, and drawn to a switchback path 84. Then the sheet S is conveyed to a duplex conveyance path 85, with the trailing edge of the sheet S serving as the leading edge of the sheet S.

Drum Cartridge

Figure 2:
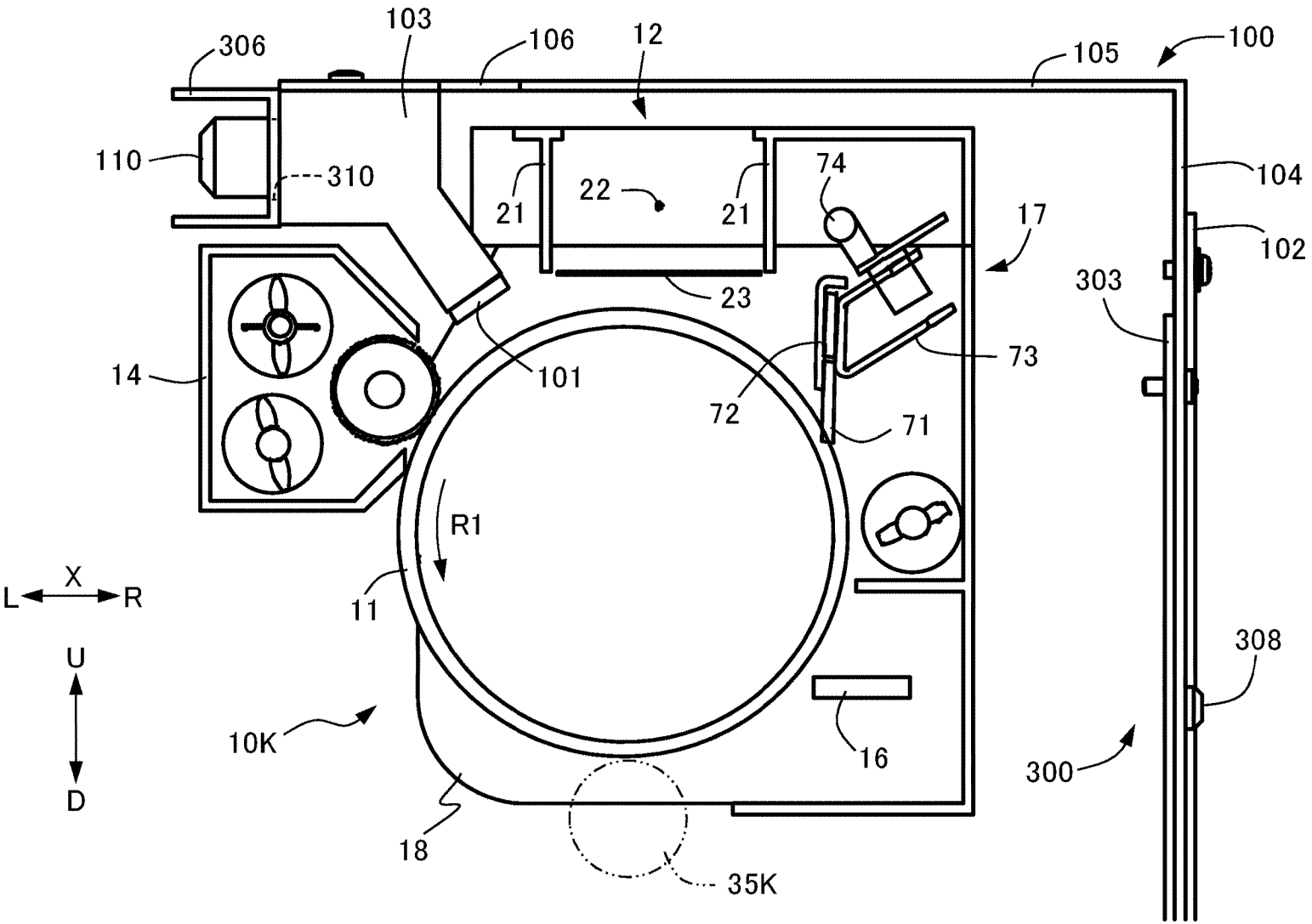
FIG. 2 is a cross-sectional view illustrating a sensor unit and a drum cartridge of the first embodiment.

As illustrated in FIG. 2, the drum cartridge 10K includes the photosensitive drum 11 that is one example of the photosensitive member, the charging unit 12, the developing apparatus 14 that is one example of a developing unit, the electricity-removal-and-exposure portion 16, and the cleaning unit 17.

The photosensitive drum 11 is a rotatable (movable) photosensitive member, which is used as an image bearing member in electrophotography. The photosensitive drum 11 is an image bearing member having a negatively-charged organic photosensitive layer. In the present embodiment, the photosensitive drum 11 has an outer diameter of 84 mm and a length of 380 mm, and rotates at a rotational speed of 350 mm/s in a rotational direction R1 indicated in FIG. 2. The photosensitive drum 11 includes an aluminum cylinder, and the photosensitive layer formed on the aluminum cylinder and having a thickness of about 30 μm. Note that although the photosensitive drum 11 of the present embodiment includes the aluminum cylinder and the photosensitive layer formed on the aluminum cylinder, the photosensitive drum 11 may have another configuration. For example, the photosensitive drum 11 may be an amorphous silicon drum.

Figure 3:
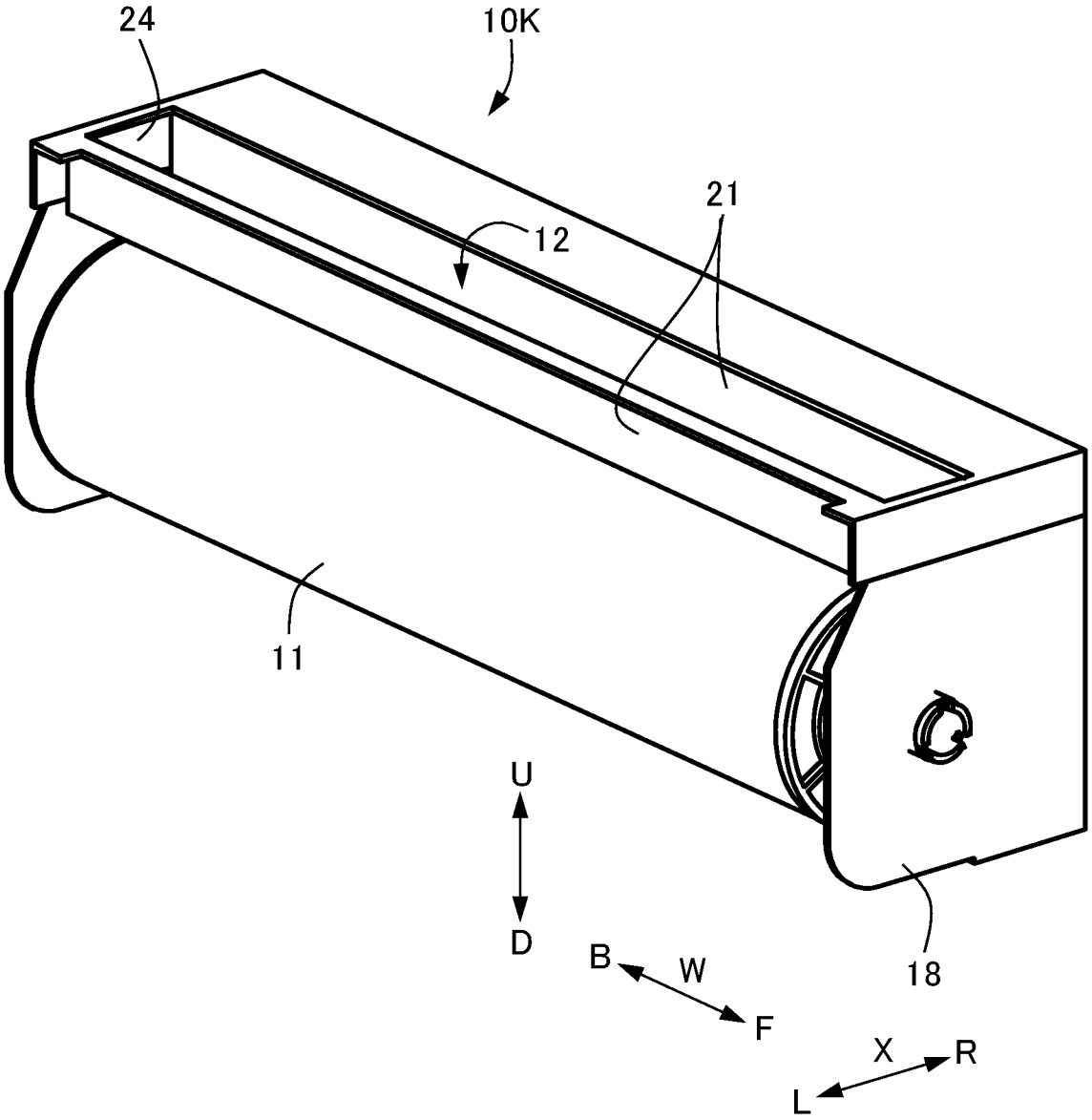
FIG. 3 is a perspective view illustrating a photosensitive drum of the first embodiment.

The charging unit 12 is held by the frame 18, which holds the photosensitive drum 11. The charging unit 12 makes the potential of the surface of the photosensitive drum 11 uniform before the surface of the photosensitive drum 11 is exposed by the laser scanner 13K. In general, the charging unit 12 is a scorotron charger that includes a grid electrode, or a roller charger that uses a charging roller. In the present embodiment, a scorotron charger is used, as one example. The charging unit 12 is detachably attached to an apparatus body 1*a*. As illustrated in FIG. 3, the charging unit 12 is disposed along a rotation-axis direction (front-and-back direction W) of the photosensitive drum 11, at a position that faces the photosensitive drum 11.

The charging unit 12 includes a pair of shield plates 21 that serve as shield electrodes, a front block (not illustrated) disposed on the front direction F side of the charging unit 12, and a back block 24 disposed on the back direction B side. The pair of shield plates 21 is made of stainless steel (SUS). The shield plates 21 are disposed so as to face each other in a right-and-left direction X (that is, a lateral direction of the photosensitive drum 11 orthogonal to the rotation-axis direction of the photosensitive drum 11), separated from each other by a predetermined distance of about 30 mm for example. The shield plates 21, the front block, and the back block 24 form a housing that is opened in the up-and-down direction. The front block and the back block 24 hold a discharge wire 22 and a grid electrode 23, which will be described later, such that the discharge wire 22 and the grid electrode 23 are stretched between the front block and the back block 24 in the front-and-back direction W (longitudinal direction).

The discharge wire 22 serves as a discharge electrode, and is disposed inside the pair of shield plates 21 (i.e., in the housing). When the discharge wire 22 is applied with a charging voltage by a high-voltage power supply (not illustrated), the discharge wire 22 causes corona discharge. The discharge wire 22 is a wire made of a material, such as stainless steel, nickel, molybdenum, or tungsten. As the diameter of the discharge wire 22 decreases, the discharge wire 22 more easily breaks. This is because the discharging of electricity produces ions that collide with the discharge wire 22. In contrast, as the diameter of the discharge wire 22 increases, the discharge wire 22 involves higher charging voltage for causing steady corona discharge. However, if the charging voltage is too high, ozone is easily produced by discharging electricity. In view of this, it is preferable that the discharge wire 22 has a diameter of 40 to 100 μm. In the present embodiment, the discharge wire 22 is a tungsten wire having a diameter of 60 μm, as one example. Note that the discharge electrode is not limited to the above-described discharge wire 22. For example, the discharge wire may have saw teeth that are concave and convex potions formed in the longitudinal direction.

The grid electrode 23 is disposed between the photosensitive drum 11 and the discharge wire 22. In addition, the grid electrode 23 is disposed closer to the surface of the photosensitive drum 11, and can be detached. The grid electrode 23 is stretched by a predetermined amount of tension in the rotation-axis direction (front-and-back direction W or longitudinal direction) of the photosensitive drum 11. When the grid electrode 23 is applied with a high voltage by a high-voltage power supply (not illustrated), the amount of current that flows to the photosensitive drum 11 can be controlled by the grid electrode 23. With this operation, the charge potential of the surface of the photosensitive drum 11, produced when the surface of the photosensitive drum 11 is charged, is controlled. As the grid electrode 23 is disposed closer to the photosensitive drum 11, the surface of the photosensitive drum 11 can be charged more uniformly. In the present embodiment, the shortest distance between the grid electrode 23 and the photosensitive drum 11 is 1.3±0.3 mm. In addition, the distance between the grid electrode 23 and the discharge wire 22 is 8 mm.

The developing apparatus 14 develops an electrostatic latent image formed on the surface of the photosensitive drum 11, by using toner. As illustrated in FIG. 2, the cleaning unit 17 is held by the frame 18 that holds the photosensitive drum 11. The cleaning unit 17 is disposed downstream of the primary transfer roller 35K and upstream of the charging unit 12 in the rotational direction R1 of the photosensitive drum 11. The cleaning unit 17 is in contact with the photosensitive drum 11, and cleans the surface of the photosensitive drum 11.

A cleaning blade 71 is a flat rubber blade formed like a strip, and scrapes the transfer residual toner left on the photosensitive drum 11. The leading edge of the rubber blade is in pressure contact with the photosensitive drum 11, toward a direction counter to the rotational direction R1 of the photosensitive drum 11. In the present embodiment, the rubber blade has a thickness of 2 mm, a width of 12.5 mm, and a length of 350 mm, and is made of urethane rubber, as an example. The cleaning blade 71 is stuck to a blade support plate 72 via adhesive or the like. Thus, the cleaning blade 71 is positioned with respect to the photosensitive drum 11 by fastening the blade support plate 72. The blade support plate 72 is fastened to a swing plate 73. The swing plate 73 is a metal plate that causes the cleaning blade 71 to abut against the photosensitive drum 11 such that the cleaning blade can swing. The swing plate 73 has a blade attachment surface to which the blade support plate 72 is fastened, and a center of swing. The swing plate 73 is supported by a rotation support portion 74 such that the swing plate 73 can rotate on the rotation support portion 74. The rotation support portion 74 is disposed on the frame 18.

The cleaning blade 71 is pressed against the photosensitive drum 11 by a pressing portion (not illustrated). The pressing portion causes the leading edge of the cleaning blade 71 to be in pressure contact with the photosensitive drum 11 such that the swing plate 73 can rotate. The pressure applied from the cleaning blade 71 to the center of the photosensitive drum 11 is called blade pressure. The suitable blade pressure is in a range from 600 to 1200 gf, and depends on the length and the hardness of the cleaning blade 71. In the present embodiment, the blade pressure is set at 900 gf.

Sensor Unit

Next, a configuration of the sensor unit 100 of the present embodiment will be described. As illustrated in FIG. 2, the sensor unit 100 is detachably attached to the main-body frame 300. The sensor unit 100 may be detached from the main-body frame 300 by removing fastening members such as screws, or by unhooking engaging hooks. In another case, the sensor unit 100 may be detached from the main-body frame 300 without removing fastening members, by a user opening an exterior cover of the image forming apparatus 1. Note that in the present embodiment, the attachment-and-detachment direction of the sensor unit 100 is equal to the right-and-left direction X. The right-and-left direction X is a direction that intersects the rotation-axis direction of the photosensitive drum 11. In addition, the right-and-left direction X is a direction that intersects the rotation-axis direction of the photosensitive drum 11 and the vertical direction. The sensor unit 100 includes a potential sensor 101, an electric board 102, a positioning block 103, a fixing portion 104, and a linking portion 105. The positioning block 103 is one example of a support portion, and supports the potential sensor 101. The fixing portion 104 is fixed to the apparatus body 1*a*. The electric board 102 is connected to the potential sensor 101, and receives a detection signal from the potential sensor 101 and sends the signal to a control unit that controls the electric board 102. The linking portion 105 links the positioning block 103 and the fixing portion 104. The fixing portion 104 and the linking portion 105 are plate-like members, and are disposed substantially orthogonal to each other. In the present embodiment, the fixing portion 104 and the linking portion 105 are formed by bending a continuous plate into a substantially L-shaped plate, as illustrated in FIG. 2.

The potential sensor 101 measures the potential of the surface of the photosensitive drum 11. The potential sensor 101 is disposed downstream of the charging unit 12 and upstream of the developing apparatus 14 in the rotational direction R1 of the photosensitive drum 11. In this arrangement, the potential sensor 101 measures the potential of the surface of the photosensitive drum 11 before the surface is subjected to the development. In the present embodiment, the detection surface of the potential sensor 101 is positioned such that the distance between the detection surface and the surface of the photosensitive drum 11 is 1.0 mm, as one example. The result detected by the potential sensor 101 is used for determining a voltage applied to the discharge wire 22 or the grid electrode 23 and adjusting the surface potential of the photosensitive drum 11.

Figure 4A:
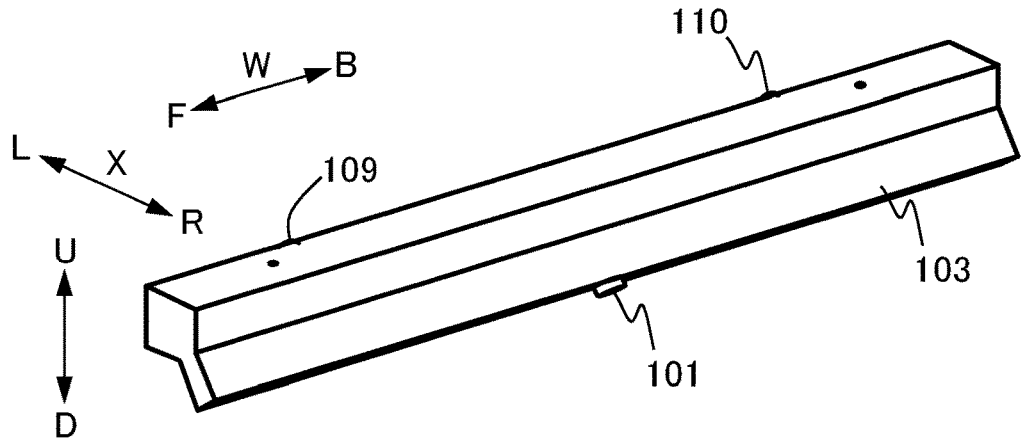
FIG. 4A is a perspective view of a positioning block of the sensor unit of the first embodiment, viewed from a right side.
Figure 4B:
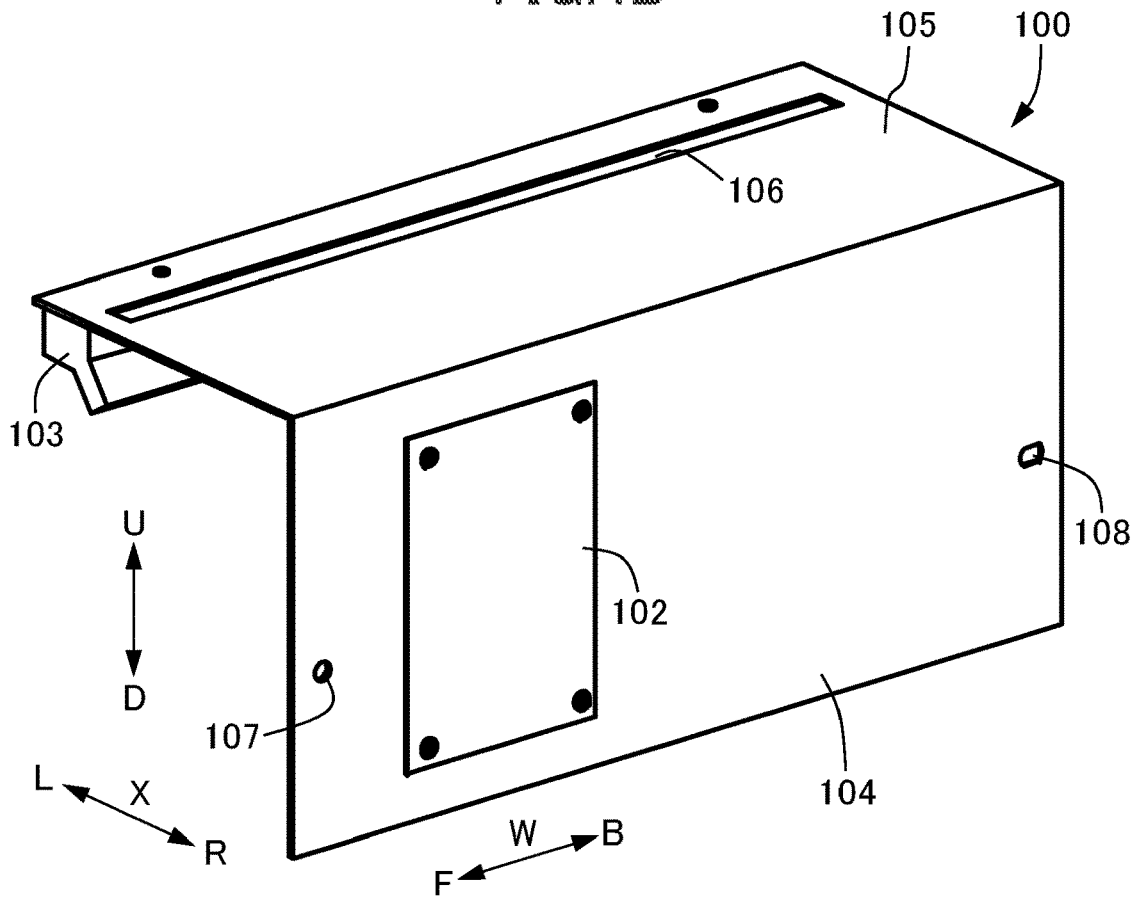
FIG. 4B is a perspective view of the sensor unit of the first embodiment, viewed from a right side.
Figure 5:
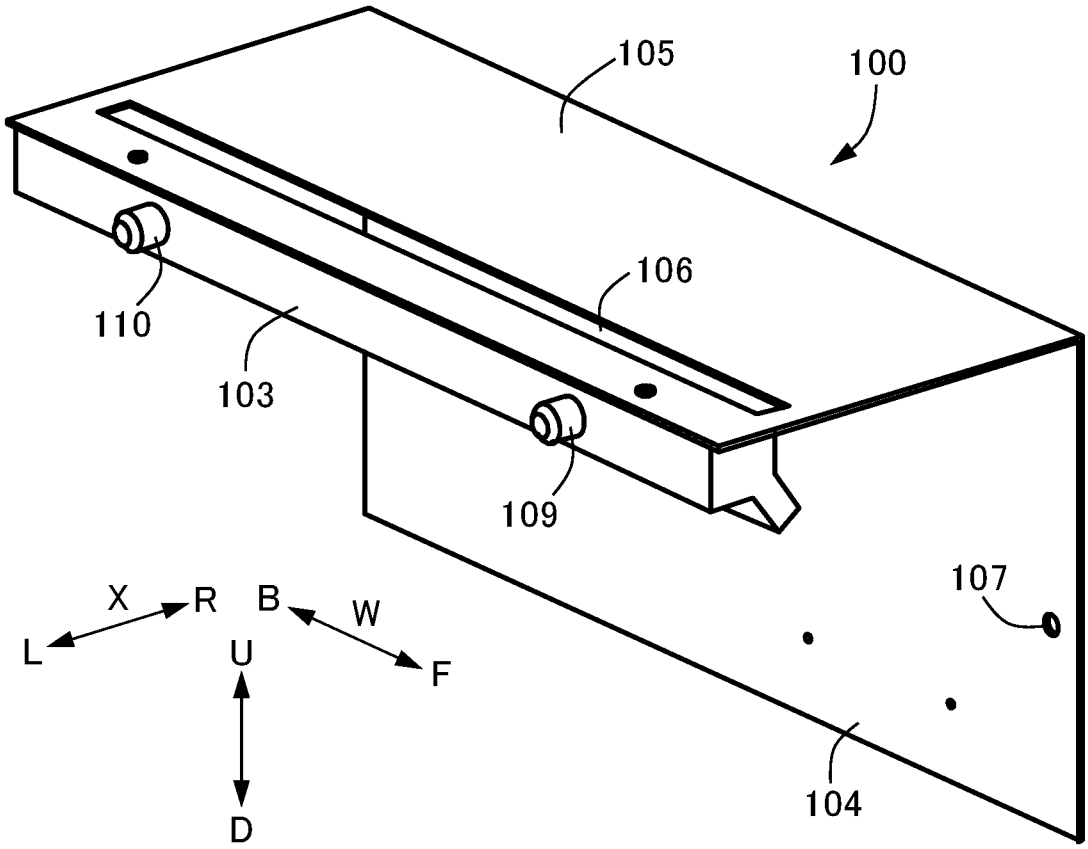
FIG. 5 is a perspective view of the sensor unit of the first embodiment, viewed from a left side.

FIGS. 4A to 5 illustrate the sensor unit 100 of the present embodiment. As illustrated in FIG. 5, the positioning block 103 extends in its longitudinal direction that is equal to the front-and-back direction W, and is fastened to a lower surface of a leading edge portion (on the left direction L side) of the linking portion 105, with screws or the like. As illustrated in FIGS. 2 and 4A, the potential sensor 101 is fastened to a substantially central portion of a surface (that faces the photosensitive drum 11) of the positioning block 103, with screws or the like. As illustrated in FIG. 4B, a substantially rectangular optical-path hole portion 106 is disposed in the top surface of the linking portion 105. The optical-path hole portion 106 allows the laser beam from the laser scanner 13K to pass through the optical-path hole portion 106 and the photosensitive drum 11 to be irradiated with the laser beam.

The electric board 102 is fastened to a side surface (on the right direction R side) of the fixing portion 104, with screws or the like. That is, the electric board 102 is disposed opposite to the photosensitive drum 11 with respect to the cleaning unit 17. The electric board 102 is connected with the potential sensor 101 via a cable (not illustrated). The value of potential detected by the potential sensor 101 is adjusted with the same electric board 102 in consideration of the resistance value of the cable and the variation of the electric board 102. For this reason, if it is necessary to replace the potential sensor 101 or the electric board 102 in assembly in a factory or after installation in a user site, both of the potential sensor 101 and the electric board 102 will be replaced. The fixing portion 104 has a positioning hole portion 107 and a rotation prevention hole portion 108, which are used for positioning the fixing portion 104 with respect to a later-described right plate 303 of the main-body frame 300. The positioning hole portion 107 has a substantially perfect circle shape, and the rotation prevention hole portion 108 has a long hole shape whose longitudinal direction is equal to the front-and-back direction W.

Main-Body Frame

Figure 6:
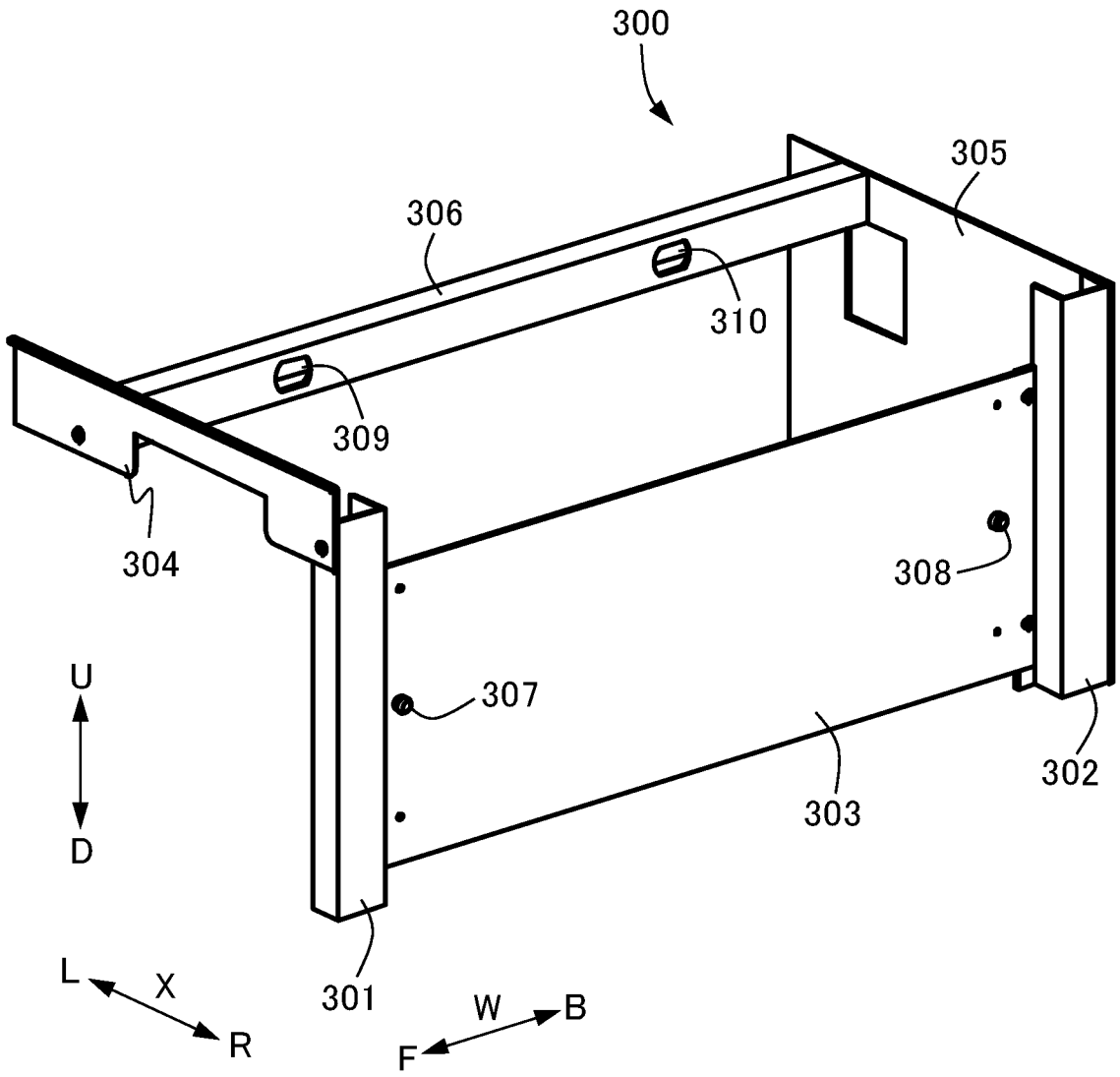
FIG. 6 is a perspective view of a main-body frame of the first embodiment, viewed from a right side.

FIG. 6 illustrates a schematic configuration of the main-body frame 300 that is one example of a support frame. The main-body frame 300 is formed mainly by using metal plates, and is disposed inside the apparatus body 1*a* of the image forming apparatus 1 for holding various units of an image forming portion and a sheet conveyance portion. The main-body frame 300 supports the drum cartridge 10K. That is, the main-body frame 300 indirectly supports the photosensitive drum 11, the charging unit 12, and the developing apparatus 14. Note that FIG. 6 illustrates a part of the main-body frame 300 disposed in the apparatus body 1*a*.

The main-body frame 300 includes a front pillar 301, a back pillar 302, the right plate 303, a front plate 304, a back plate 305, and a stay 306. The front pillar 301 is disposed on the right front side of the image forming apparatus 1, and the back pillar 302 is disposed on the right back side of the image forming apparatus 1. Note that in the present embodiment, a part of the main-body frame 300 on the downward direction D side (i.e., on the sheet conveyance portion side) is not illustrated in the figures. The right plate 303 extends from the front pillar 301 to the back pillar 302, and is fastened to the front pillar 301 and the back pillar 302 with screws or the like. The fixing portion 104 of the sensor unit 100 is fixed to the right plate 303 with screws or the like. The right plate 303 has a front boss 307 and a back boss 308 that project from a side surface of the right plate 303 on the right direction R side, toward the right direction R. The front boss 307 and the back boss 308 are used for positioning the fixing portion 104 of the sensor unit 100 with respect to the right plate 303. The front boss 307 is disposed on the front direction F side of the back boss 308.

The front plate 304 is a support plate disposed in a front surface portion of the apparatus body 1*a* and above the drum cartridge 10K. In the present embodiment, the front plate 304 extends from the front pillar 301 to a left pillar (not illustrated), and is fastened to the front pillar 301 and the left pillar with screws or the like. Note that in the present embodiment, only a part of the main-body frame 300 around the sensor unit 100 is illustrated in the figures, and a part of the main-body frame 300 on the left direction L side is not illustrated. The back plate 305 extends from the back pillar 302 to a left pillar (not illustrated), and is fastened to the back pillar 302 and the left pillar with screws or the like. Note that in the present embodiment, only a part of the main-body frame 300 around the sensor unit 100 is illustrated in the figures, and a part of the main-body frame 300 on the downward direction D side (i.e., sheet conveyance portion side) and on the left direction L side is not illustrated. The stay 306 is a component to which the positioning block 103 is positioned. In the present embodiment, the stay 306 extends in its longitudinal direction that is equal to the front-and-back direction W. Specifically, the stay 306 extends from the front plate 304 to the back plate 305, and is fixed to the front plate 304 and the back plate 305 with screws or through welding.

As illustrated in FIG. 2, the result detected by the potential sensor 101 has less error as the distance between the potential sensor 101 and the photosensitive drum 11 varies less. However, the potential sensor 101 is disposed between the charging unit 12 and the developing apparatus 14, and the electric board 102 is disposed opposite to the potential sensor 101 with respect to the photosensitive drum 11 and the cleaning unit 17. That is, the fixing portion 104 is fixed to the right plate 303 at a position opposite to the potential sensor 101 with respect to the photosensitive drum 11 when viewed from the rotation-axis direction of the photosensitive drum 11. The position is a position that faces a part of an area from the developing apparatus 14 to the charging unit 12 in the rotational direction of the photosensitive drum 11. Thus, even if the potential sensor 101 and the electric board 102 are integrated into the sensor unit 100, the potential sensor 101 remains separated from the electric board 102. In this configuration, the distance between the potential sensor 101 and the fixing portion 104 that fixes the sensor unit 100 remains long, and the potential sensor 101 is in a state in which the potential sensor 101 is supported by a cantilever that extends from the fixing portion 104. As a result, the positional accuracy of the potential sensor may deteriorate, deteriorating the measurement accuracy on the charge potential of the surface of the photosensitive member. The deterioration on the measurement accuracy may cause image defects. As countermeasures, in the present embodiment, the positioning block 103 of the sensor unit 100 and the stay 306 of the main-body frame 300 are positioned with respect to each other for increasing the positional accuracy of the potential sensor 101.

Configuration for Positioning Potential Sensor

Hereinafter, a configuration to position the positioning block 103 with respect to the stay 306 will be described in detail. As illustrated in FIG. 5, a first boss 109 and a second boss 110 are disposed on the leading edge portion of the positioning block 103 on the left direction L side, and used for positioning the positioning block 103 with respect to the stay 306 of the main-body frame 300 as described later. The first boss 109 and the second boss 110 are one example of a first positioning portion. Each of the first boss 109 and the second boss 110 is a round boss whose center axis extends along the right-and-left direction X (attachment-and-detachment direction) in which the sensor unit 100 is attached to or detached from the main-body frame 300. The first boss 109 is disposed at a position different from a position of the second boss 110 in the front-and-back direction W (width direction) that intersects the rotational direction R1 (see FIG. 2) of the photosensitive drum 11. In the present embodiment, the first boss 109 and the second boss 110 have an identical length. However, the first boss 109 and the second boss 110 may have different lengths.

On the other hand, as illustrated in FIG. 6, the stay 306 of the main-body frame 300 has a first fitting hole portion 309 and a second fitting hole portion 310, which are one example of a second positioning portion. Each of the first fitting hole portion 309 and the second fitting hole portion 310 has a center axis extending along the right-and-left direction X, and passes through the stay 306. In addition, each of the first fitting hole portion 309 and the second fitting hole portion 310 is a long hole whose longitudinal direction is equal to the front-and-back direction W. The first fitting hole portion 309 is disposed at a position at which the first boss 109 fits in the first fitting hole portion 309 when the sensor unit 100 is attached to the main-body frame 300. The second fitting hole portion 310 is disposed at a position at which the second boss 110 fits in the second fitting hole portion 310 when the sensor unit 100 is attached to the main-body frame 300. Thus, the first boss 109 and the second boss 110 are respectively fit in the first fitting hole portion 309 and the second fitting hole portion 310, and thereby the sensor unit 100 is positioned with respect to the main-body frame 300. Consequently, the potential sensor 101 is disposed between the charging unit 12 and the developing apparatus 14, at a predetermined position that faces the surface of the photosensitive drum 11.

Attachment Procedure of Sensor Unit

Figure 7:
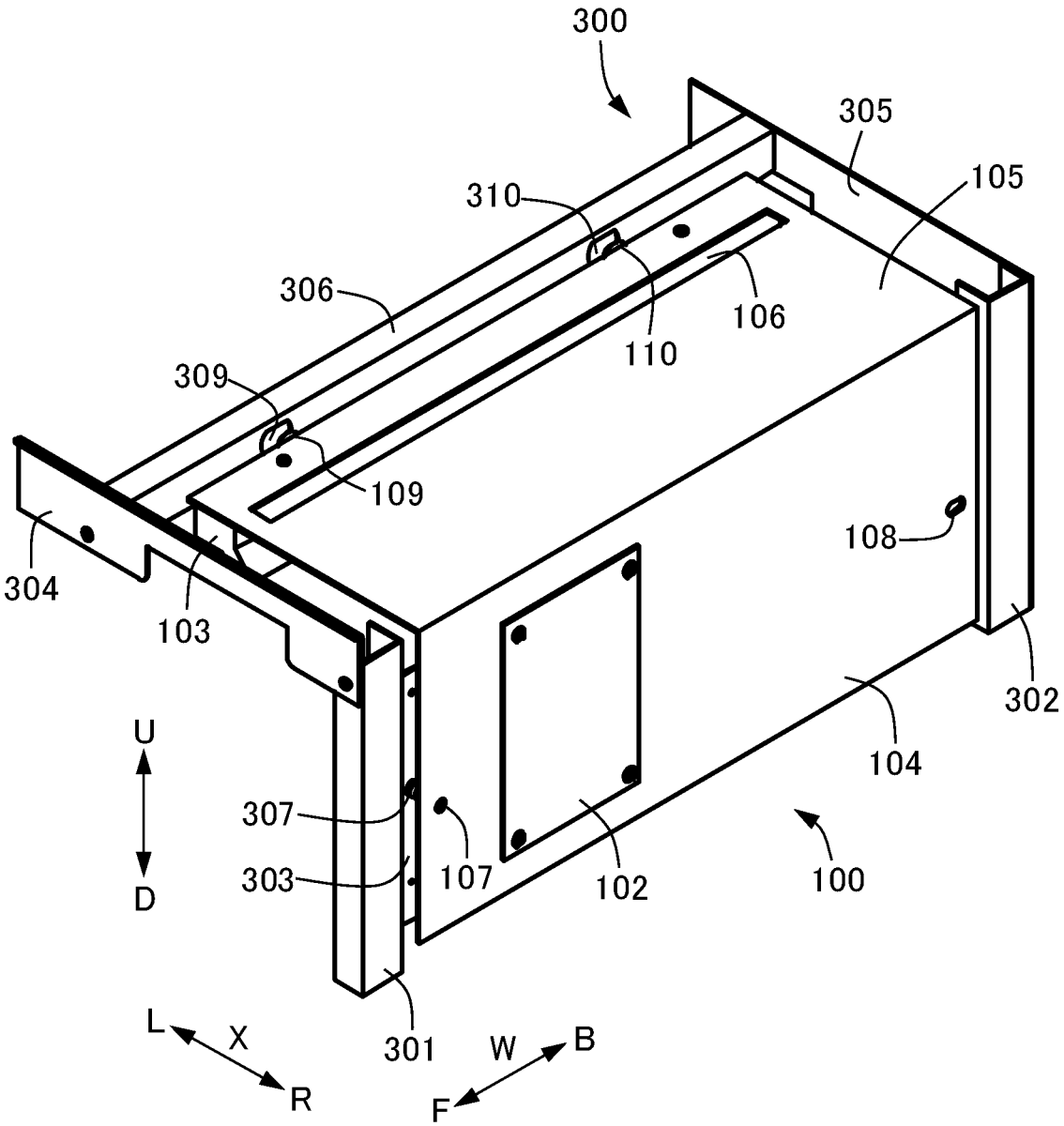
FIG. 7 is a perspective view viewed from a right side and illustrating a state in which the sensor unit is being attached to the main-body frame of the first embodiment.
Figure 8:
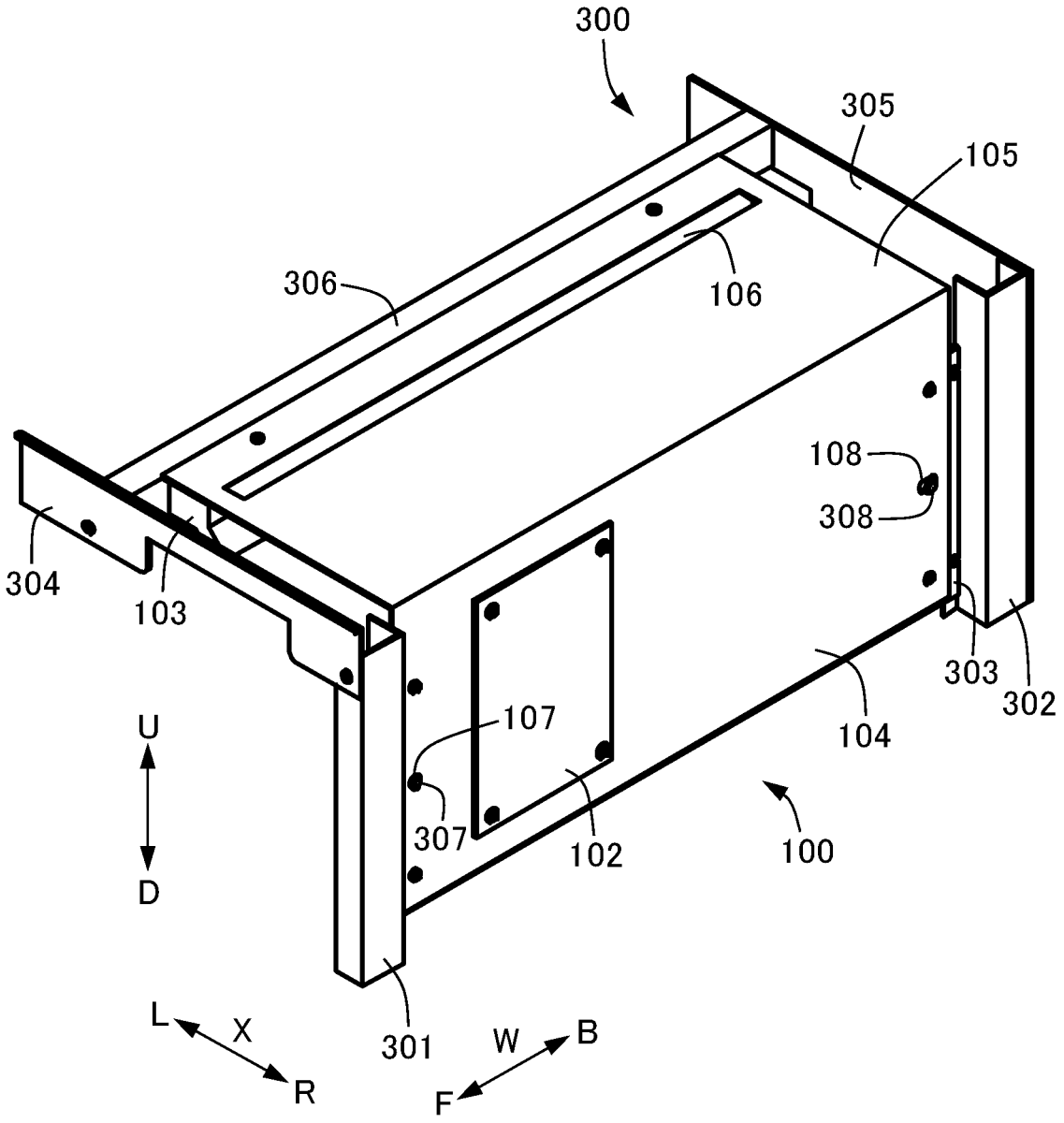
FIG. 8 is a perspective view viewed from a right side and illustrating a state in which the sensor unit has been attached to the main-body frame of the first embodiment.

Next, a procedure in which the sensor unit 100 of the present embodiment is attached to the main-body frame 300 will be described with reference to FIGS. 7 and 8. FIG. 7 illustrates a state in which the attachment of the sensor unit 100 is being performed, and FIG. 8 illustrates a state in which the attachment of the sensor unit 100 has been completed. For example, the attachment procedure is performed when the sensor unit 100 is assembled to the main-body frame 300 in a factory, or when the sensor unit 100 is replaced in servicing work in a user site. Note that since the drum cartridge 10K would overlap with the trajectory of the positioning block 103 when the sensor unit 100 is inserted in the main-body frame 300, the drum cartridge 10K is removed in advance from the image forming apparatus 1.

First, as illustrated in FIG. 7, the sensor unit 100 to which the potential sensor 101 (see FIG. 4A) and the electric board 102 are fixed is inserted in the main-body frame 300 in a direction from the right direction R side of the apparatus body 1*a* (see FIG. 1) to the left direction L side. Then the first boss 109 and the second boss 110 disposed on the positioning block 103 are fit in the first fitting hole portion 309 and the second fitting hole portion 310 disposed in the stay 306. With this operation, the potential sensor 101 is disposed between the charging unit 12 and the developing apparatus 14, at a predetermined position that faces the surface of the photosensitive drum 11.

Then, as illustrated in FIG. 8, the front boss 307 and the back boss 308 of the right plate 303 is fit in the positioning hole portion 107 and the rotation prevention hole portion 108 disposed in the fixing portion 104. The fixing portion 104 is then fastened to the right plate 303 with screws, and the attachment of the sensor unit 100 is completed.

As described above, the image forming apparatus 1 of the present embodiment includes the sensor unit 100, into which the potential sensor 101 and the electric board 102 are integrated. Thus, since the unit of the potential sensor 101 and the electric board 102 can be attached to the apparatus body 1*a*, the operation time required to attach the unit to the apparatus body 1*a* can be reduced compared to the operation time required to attach the potential sensor 101 and the electric board 102 separately to the apparatus body 1*a*.

In addition, in the image forming apparatus 1 of the present embodiment, the first boss 109 and the second boss 110 disposed on the positioning block 103 are respectively fit in the first fitting hole portion 309 and the second fitting hole portion 310 disposed in the stay 306. Thus, when the sensor unit 100 is attached to the apparatus body 1*a*, the positioning block 103 is positioned with respect to the stay 306, and the potential sensor 101 is disposed between the charging unit 12 and the developing apparatus 14, at a predetermined position that faces the surface of the photosensitive drum 11. Since the potential sensor 101 can be positioned at a position closer to the photosensitive drum 11, the measurement accuracy for the charge potential of the photosensitive drum 11 can be increased, compared to the case in which the potential sensor 101 is not positioned (thus, the positional accuracy is poor) and supported by a cantilever extending from the fixing portion 104. Thus, the occurrence of image defects can be suppressed.

In contrast, if the potential sensor 101 is positioned by only a portion of the fixing portion 104 located in the vicinity of the electric board 102, the distance between the potential sensor 101 and the photosensitive drum 11 may vary due to accumulated component tolerance. As a result, the positional accuracy of the potential sensor 101 may deteriorate, deteriorating the detection accuracy. In the image forming apparatus 1 of the present embodiment, however, since the positioning block 103 in the vicinity of the potential sensor 101 is positioned with respect to the main-body frame 300, both of the ease of assembly and the improvement of detection accuracy can be ensured.

In addition, in the image forming apparatus 1 of the present embodiment, the first boss 109 and the second boss 110 are formed as a first positioning portion, and the first fitting hole portion 309 and the second fitting hole portion 310 are formed as a second positioning portion. Since the bosses are fit in the corresponding fitting hole portions at two positions different from each other in the front-and-back direction W, which is orthogonal to the left direction L in which the sensor unit 100 is attached to the main-body frame 300, the positioning accuracy of the potential sensor 101 can be ensured, in particular, in a direction of rotation around the right-and-left direction X.

Note that although the description has been made for the image forming apparatus 1 of the present embodiment in which the first boss 109 and the second boss 110 are formed as a first positioning portion and the first fitting hole portion 309 and the second fitting hole portion 310 are formed as a second positioning portion, the present disclosure is not limited to this. For example, one or three or more bosses may be formed as a first positioning portion, and corresponding fitting hole portions in which the bosses can be fit may be formed as a second positioning portion. In another case, the second positioning portion may be bosses, and the first positioning portion may be fitting hole portions. In addition, although the description has been made for the image forming apparatus 1 of the present embodiment in which the first positioning portion is disposed on the positioning block 103, the present disclosure is not limited to this. For example, the first positioning portion may be disposed on the leading edge portion of the linking portion 105 on the left direction L side, and the potential sensor 101 may be disposed in the vicinity of the first positioning portion. In this case, the positioning block 103 may not be disposed.

In the above-described image forming apparatus 1 of the present embodiment, the sensor unit 100 is used for the drum cartridge 10K of black. Thus, the sensor unit 100 is attached to the main-body frame 300 of the apparatus body 1*a* in a direction from the right direction R side to the left direction L side. However, the present disclosure is not limited to this. For example, the configuration for attaching the sensor unit 100 to the main-body frame 300 may be applied for the drum cartridges 10Y, 10C, and 10M of yellow, cyan, and magenta, other than the drum cartridge 10K of black. In this case, the sensor unit 100 is detachably attached to a subframe that is disposed in a station for each color, and that can be drawn out as one portion of the main-body frame 300. In any case, since the positioning block 103 in the vicinity of the potential sensor 101 is positioned with respect to the main-body frame 300, both of the ease of assembly and the improvement of detection accuracy can be ensured.

Second Embodiment

Next, a second embodiment of the present disclosure will be described in detail with reference to FIGS. 9A to 14C. The present embodiment differs from the first embodiment in that the positioning block is replaced with a duct body 203, and that rails are provided for guiding a sensor unit 200 when the sensor unit 200 is attached to or detached from a main-body frame. Since the other configuration of the second embodiment is the same as that of the first embodiment, a component identical to that of the first embodiment is given an identical symbol and the detailed description thereof will be omitted.

Sensor Unit

Next, a configuration of the sensor unit 200 of the present embodiment will be described with reference to FIGS. 9A to 10. The sensor unit 200 includes a potential sensor 101, an electric board 102, the duct body 203, a fixing portion 104, and a linking portion 105. The duct body 203 is one example of a support portion, and supports the potential sensor 101. The fixing portion 104 is fixed to the apparatus body 1*a*.

Figure 9A:
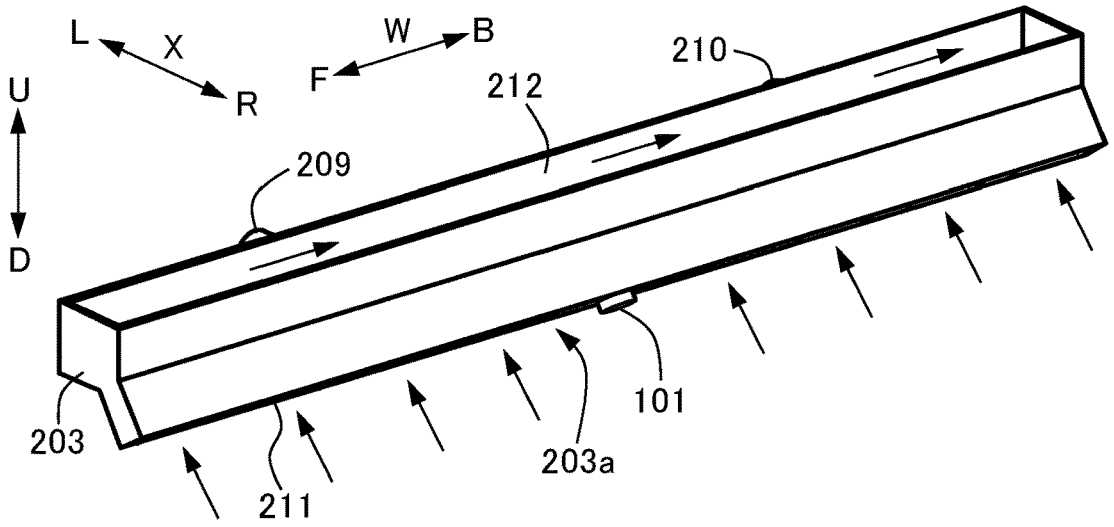
FIG. 9A is a perspective view of a duct body of a sensor unit of a second embodiment, viewed from a right side.

As illustrated in FIG. 9A, the potential sensor 101 is fastened to a substantially central portion of a surface (that faces the photosensitive drum 11) of the duct body 203, with screws or the like. The duct body 203 has a plurality of air inlets 211 formed in a surface 203*a* on which the potential sensor 101 is mounted and which faces the photosensitive drum 11. The air inlets 211 are disposed along the front-and-back direction W. In addition, the duct body 203 has a cavity 212 formed therein.

Figure 9B:
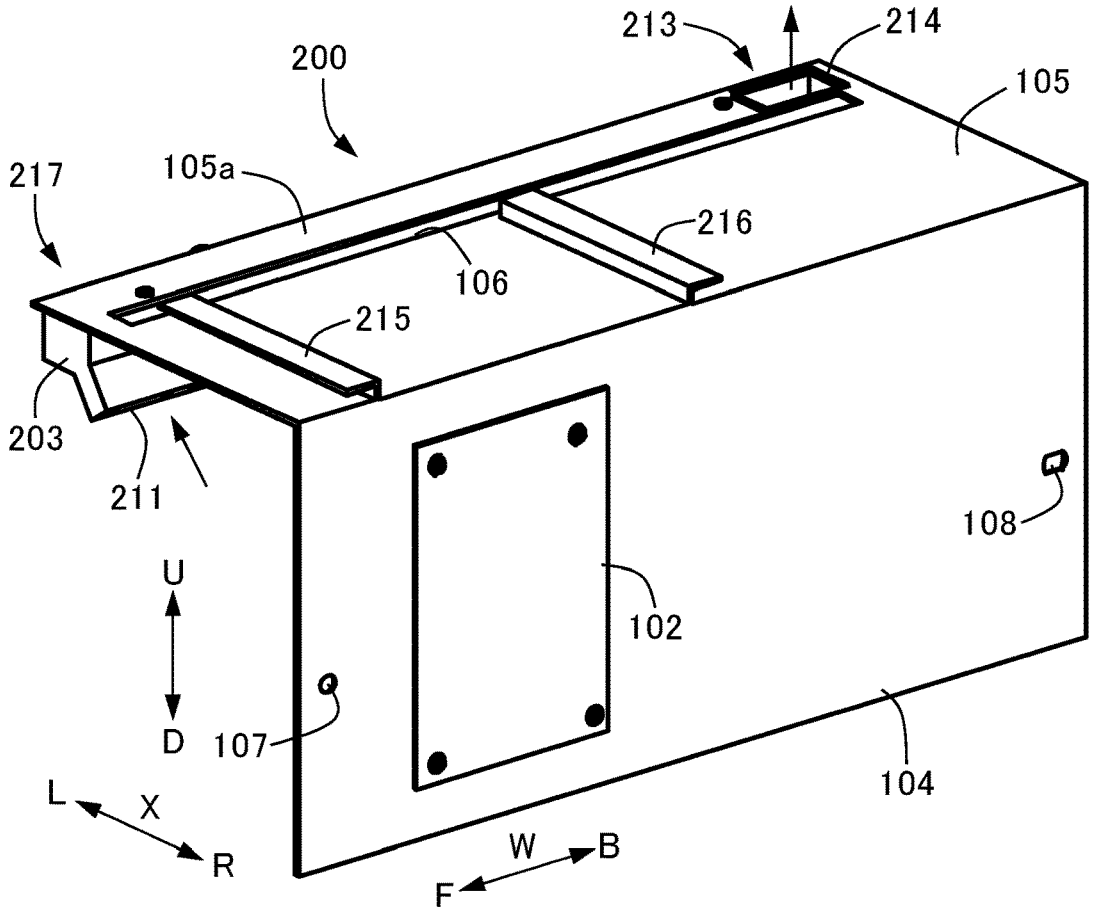
FIG. 9B is a perspective view of the sensor unit of the second embodiment, viewed from a right side.
Figure 10:
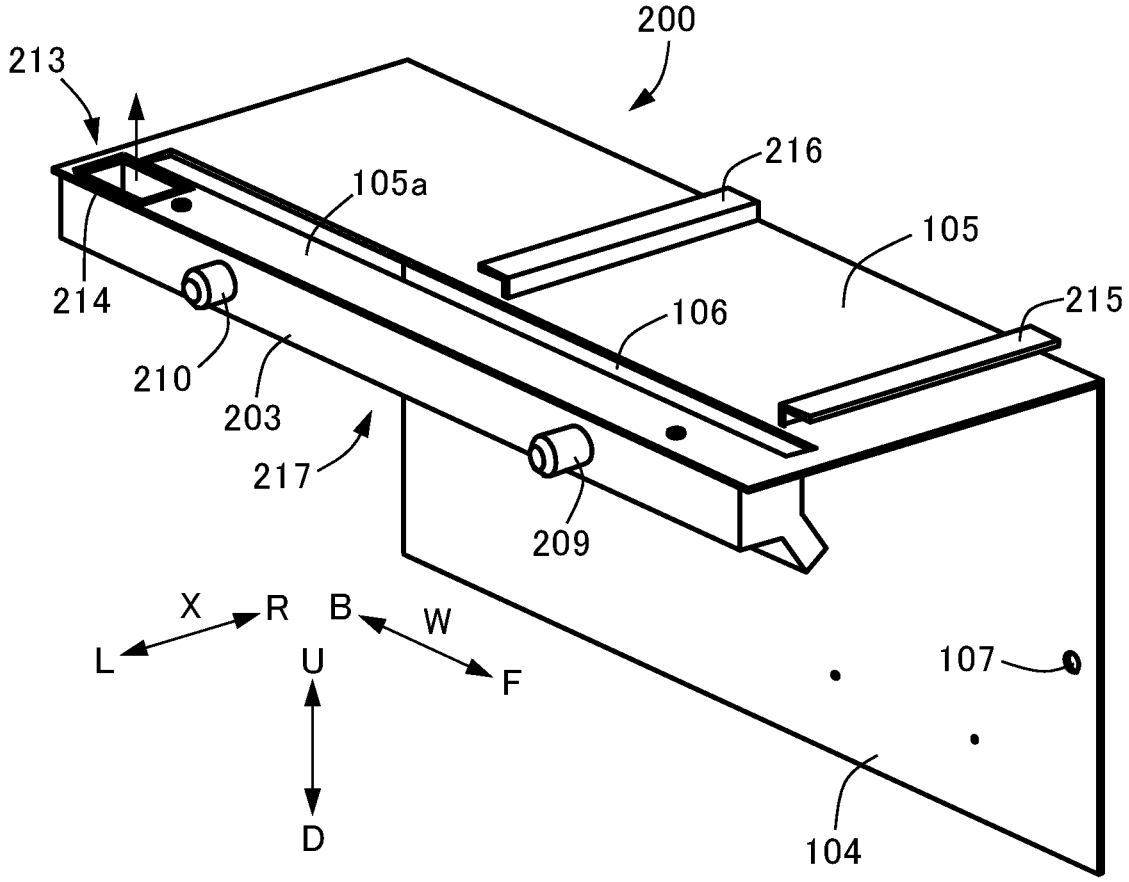
FIG. 10 is a perspective view of the sensor unit of the second embodiment, viewed from a left side.

As illustrated in FIGS. 9B and 10, the duct body 203 extends in its longitudinal direction that is equal to the front-and-back direction W, and is fastened to a lower surface of a leading edge portion 105*a* (on the left direction L side) of the linking portion 105, with screws or the like.

The linking portion 105 has a substantially rectangular joint hole portion 213 formed at a position corresponding to an end portion of the duct body 203 on the back direction B side. The joint hole portion 213 communicates with the cavity 212 (see FIG. 9A) of the duct body 203, and is one example of a second communicating opening portion. The duct body 203 is closed by the leading edge portion 105*a* of the linking portion 105, so that an air duct 217 is formed. The air duct 217 communicates with the joint hole portion 213 such that air flows from the air inlets 211 to the joint hole portion 213 through the cavity 212. Thus, when the joint hole portion 213 is joined with a joint opening portion 415 (see FIG. 12) of a main-body-side duct 411 of a later-described main-body frame 400, air is drawn from the air inlets 211 in a direction indicated by arrows of FIG. 9, then forced to flow in the cavity 212 toward the back direction B, and then discharged from the joint hole portion 213. That is, the air duct 217 can draw air around the photosensitive drum 11. In addition, a seal member 214 is stuck onto the periphery of the joint hole portion 213. Preferably, the seal member 214 is a sponge-like member. In the present embodiment, the seal member 214 has a thickness of about 3 mm.

As illustrated in FIG. 10, a first boss 209 and a second boss 210 are disposed on the leading edge portion of the duct body 203 on the left direction L side, and used for positioning the duct body 203 with respect to a stay 306 of the main-body frame 400. The first boss 209 and the second boss 210 are one example of a first positioning portion. Each of the first boss 209 and the second boss 210 is a round boss whose center axis extends along the right-and-left direction X in which the sensor unit 200 is attached to or detached from the main-body frame 400. The first boss 209 is disposed at a position different from a position of the second boss 210 in the front-and-back direction W that intersects the rotational direction R1 (see FIG. 2) of the photosensitive drum 11. In the present embodiment, the first boss 209 is shaped longer than the second boss 210 in the right-and-left direction X, which is an attachment-and-detachment direction.

In addition, a first unit rail 215 and a second unit rail 216 are disposed on the top surface of the linking portion 105. The first unit rail 215 and the second unit rail 216 are one example of a guided portion, and are guided to the main-body frame 400 when the sensor unit 200 is attached to main-body frame 400. In the present embodiment, the first unit rail 215 is a first guided portion, and the second unit rail 216 is a second guided portion. The first unit rail 215 and the second unit rail 216 extend in their longitudinal direction that is equal to the right-and-left direction X, so as not to overlap with the optical-path hole portion 106. When viewed from the right-and-left direction X, the first unit rail 215 and the second unit rail 216 are L-shaped. The first unit rail 215 is disposed on an edge portion of the linking portion 105 on the front direction F side, and the second unit rail 216 is disposed on a substantially central portion of the linking portion 105 in the front-and-back direction W. In the present embodiment, the first unit rail 215, the first boss 209, the second unit rail 216, the second boss 210, and the joint hole portion 213 are disposed in this order in a direction from the front direction F side to the back direction B side, in the front-and-back direction W.

Main-Body Frame

Figure 11:
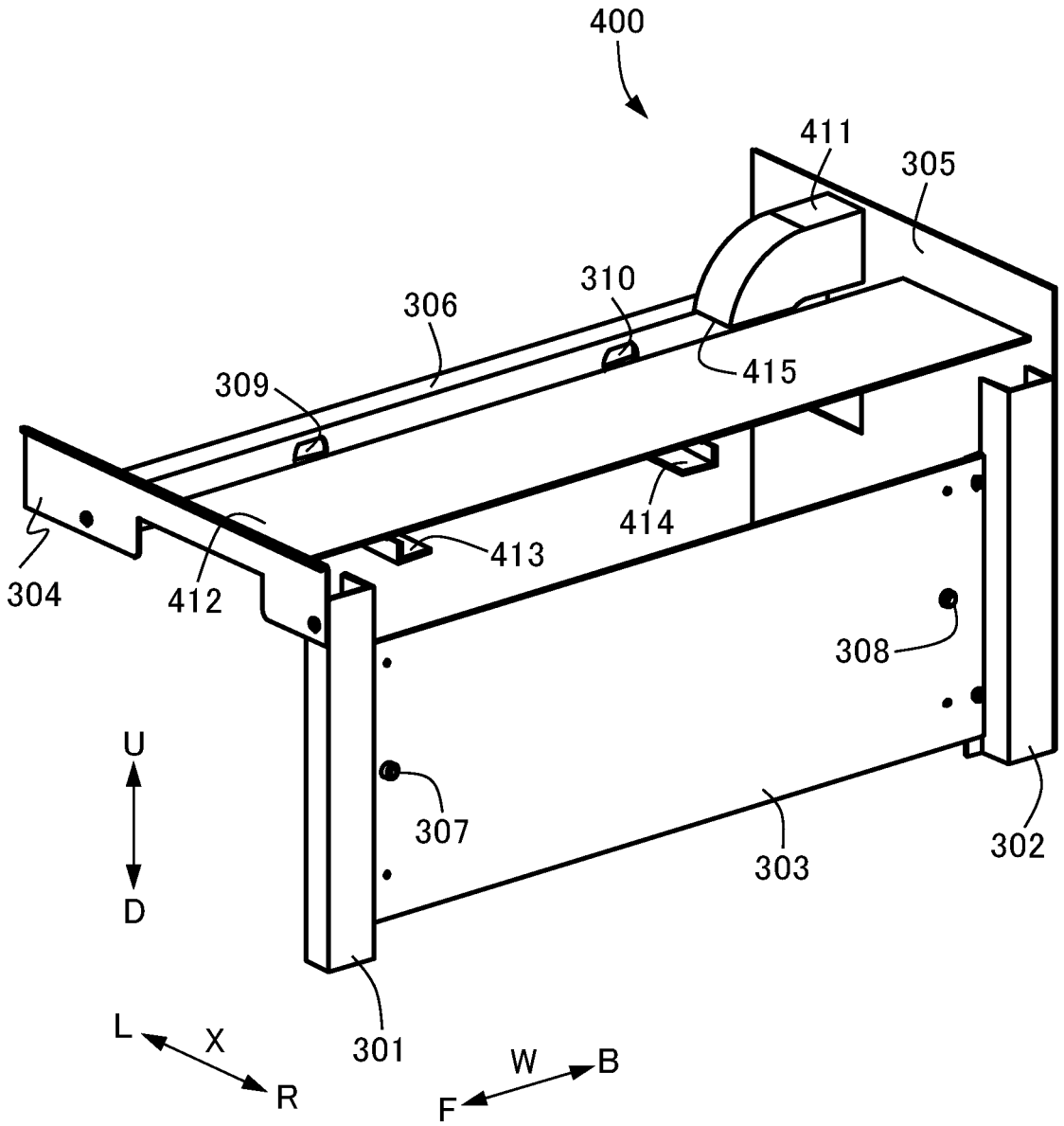
FIG. 11 is a perspective view of a main-body frame of the second embodiment, viewed from a right side.

FIG. 11 illustrates a schematic configuration of the main-body frame 400 that is one example of a support frame. The main-body frame 400 includes a front pillar 301, a back pillar 302, a right plate 303, a front plate 304, a back plate 305, and the stay 306. The back plate 305 is joined with the main-body-side duct 411, which extends in its longitudinal direction that is equal to the front-and-back direction W. The main-body-side duct 411 is joined with the back plate 305 such that a portion of the main-body-side duct 411 on the back direction B side is opened toward the back plate 305. In addition, the main-body-side duct 411 has a joint opening portion 415 disposed on the front direction F side. The joint opening portion 415 is one example of a first communicating opening portion, and is opened toward the downward direction D side. In addition, a drawing fan (not illustrated) is disposed at a position on the back direction B side of the main-body-side duct 411, and draws air at the position on the back direction B side. The joint opening portion 415 is joined with the joint hole portion 213 via the seal member 214 in a later-described attachment process of the sensor unit 200. Thus, the air around the air inlets 211 can be drawn by the drawing fan, to the back direction B side of the apparatus body 1*a* (see FIG. 1).

A rail stay 412 extends from the front plate 304 to the back plate 305, and is joined with the front plate 304 and the back plate 305. In addition, a first main-body rail 413 and a second main-body rail 414 are disposed on the bottom surface of the rail stay 412. The first main-body rail 413 and the second main-body rail 414 are one example of a guiding portion that guides the sensor unit 200 to the main-body frame 400 when the sensor unit 200 is attached to main-body frame 400. In the present embodiment, the first main-body rail 413 is a first guiding portion, and the second main-body rail 414 is a second guiding portion. The first main-body rail 413 and the second main-body rail 414 extend in their longitudinal direction that is equal to the right-and-left direction X, so as not to overlap with the optical-path hole portion 106. When viewed from the right-and-left direction X, the first main-body rail 413 and the second main-body rail 414 are L-shaped so that they can engage with the first unit rail 215 and the second unit rail 216 and guide them to the main-body frame 400. The first main-body rail 413 is disposed on an edge portion of the rail stay 412 on the front direction F side, and the second main-body rail 414 is disposed on a substantially central portion of the rail stay 412 in the front-and-back direction W. That is, the second main-body rail 414 is disposed at a position different from a position of the first main-body rail 413 in the front-and-back direction W.

As described above, the sensor unit 200 includes the first unit rail 215 and the second unit rail 216, which are guided by the first main-body rail 413 and the second main-body rail 414 of the main-body frame 400. Thus, when the sensor unit 200 is attached to the main-body frame 400, the first unit rail 215 and the second unit rail 216 are guided by the first main-body rail 413 and the second main-body rail 414 so that the first boss 209 and the second boss 210 are positioned at the first fitting hole portion 309 and the second fitting hole portion 310.

Attachment Procedure of Sensor Unit

Figure 12:
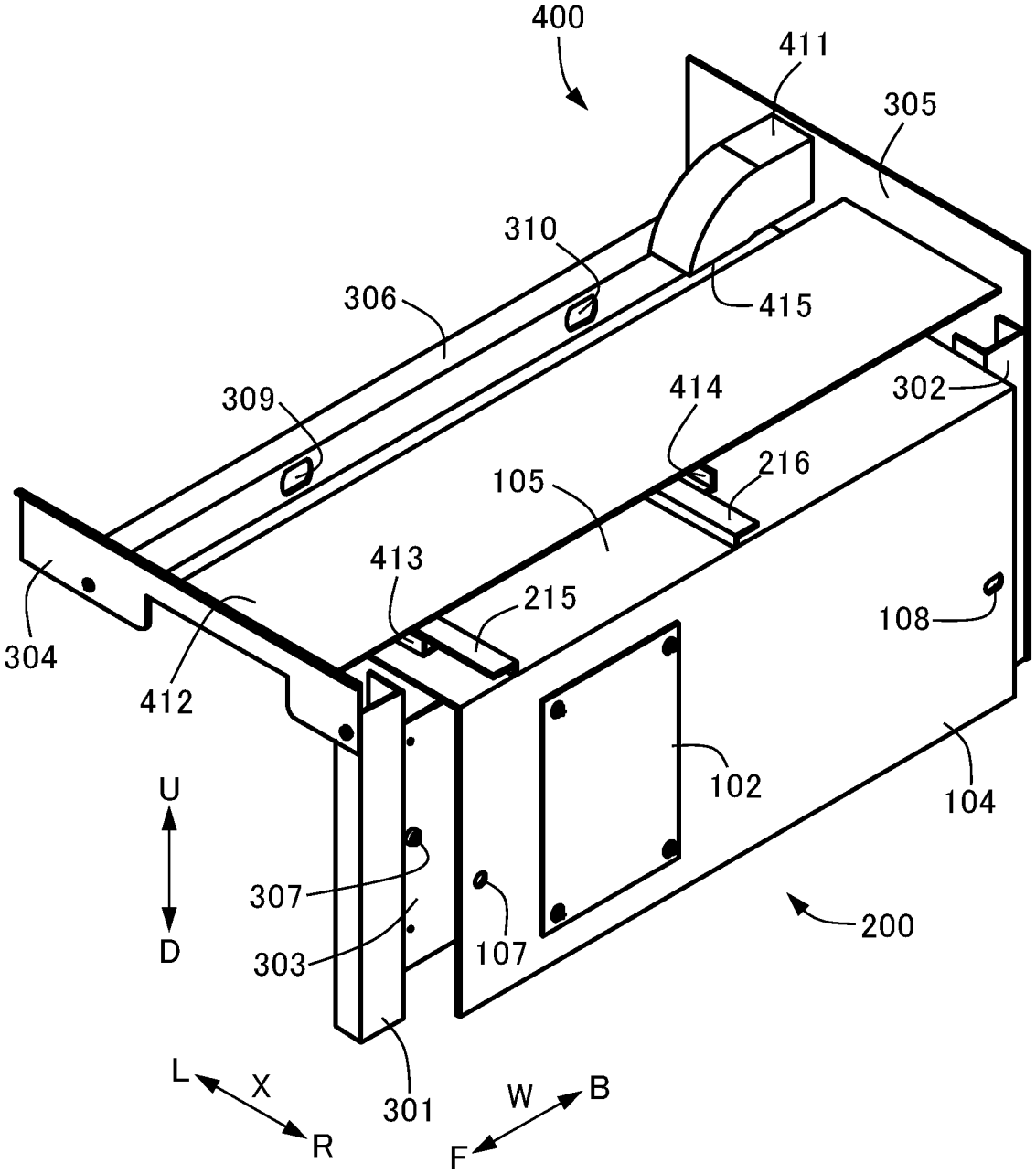
FIG. 12 is a perspective view viewed from a right side and illustrating a state in which the sensor unit is being attached to the main-body frame of the second embodiment.
Figure 13:
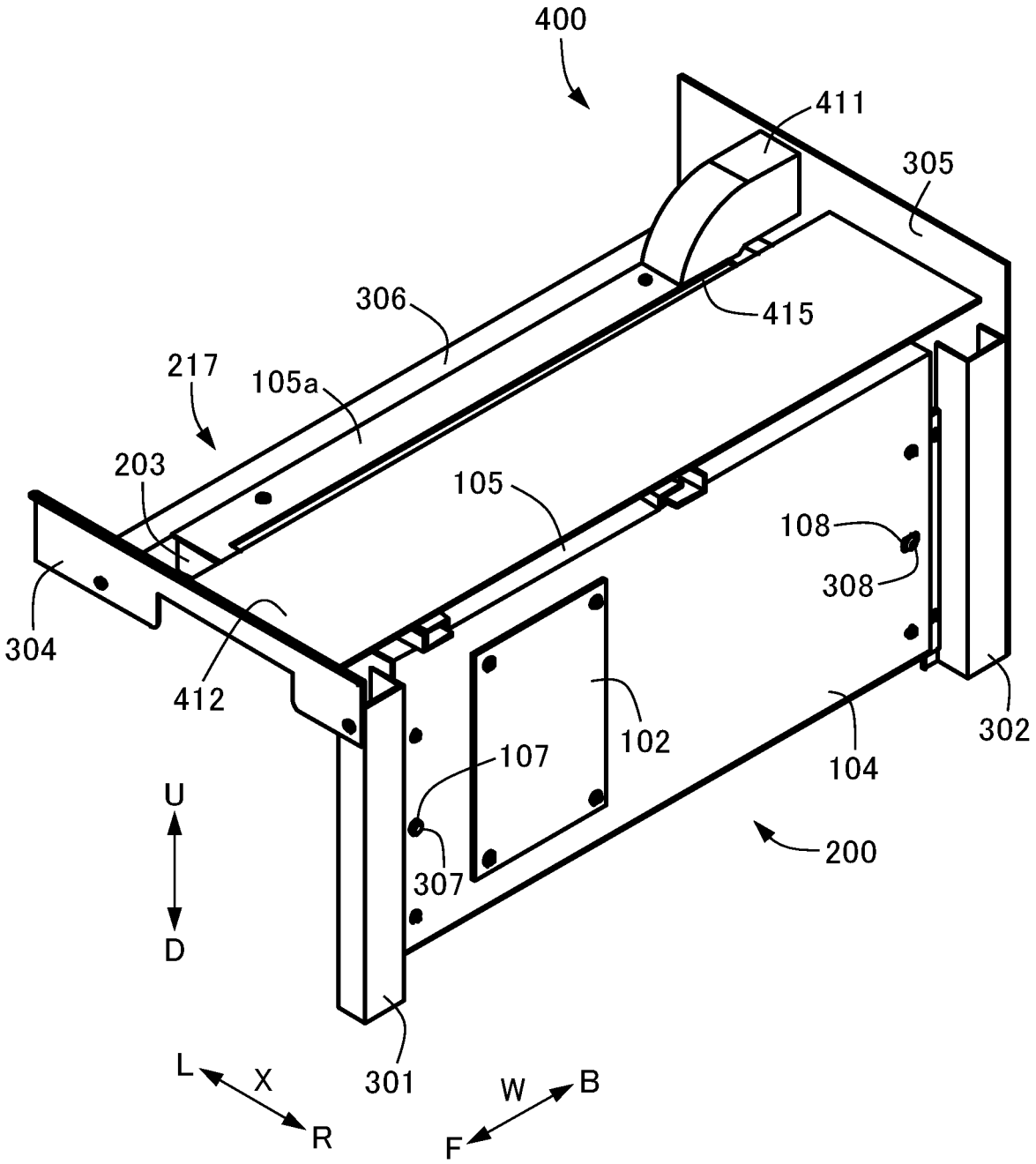
FIG. 13 is a perspective view viewed from a right side and illustrating a state in which the sensor unit has been attached to the main-body frame of the second embodiment.
Figure 14A:
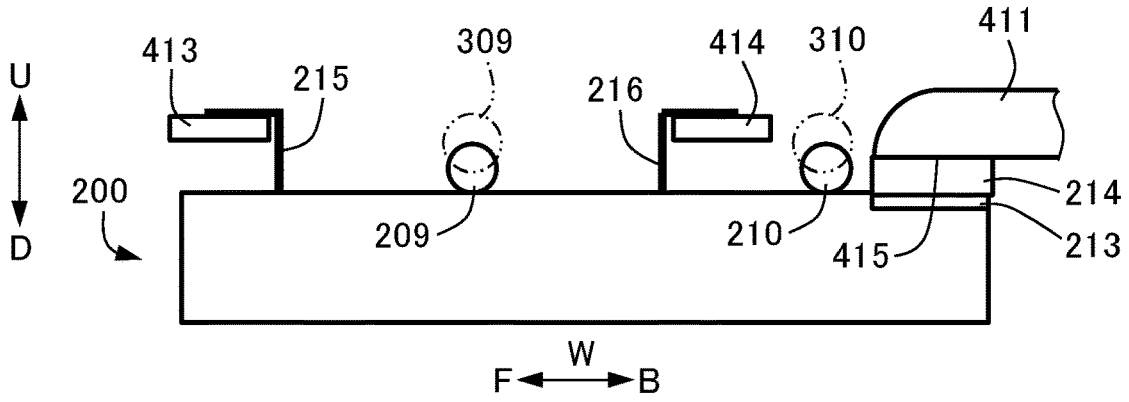
FIG. 14A is a schematic front view illustrating a state in which the sensor unit is being attached to the main-body frame of the second embodiment, and in which a first boss and a second boss are not fit in respective fitting hole portions.
Figure 14B:
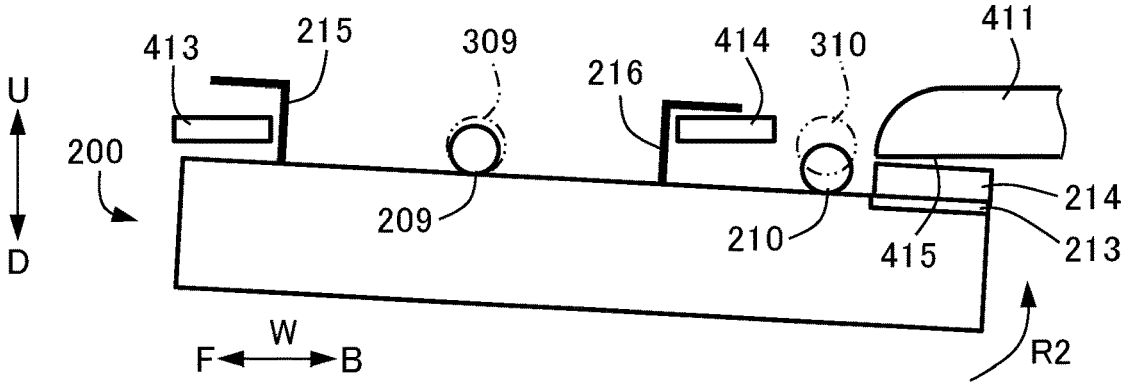
FIG. 14B is a schematic front view illustrating a state in which the sensor unit is being attached to the main-body frame of the second embodiment, and in which only a leading end portion of the first boss is fit in a corresponding fitting hole portion.
Figure 14C:
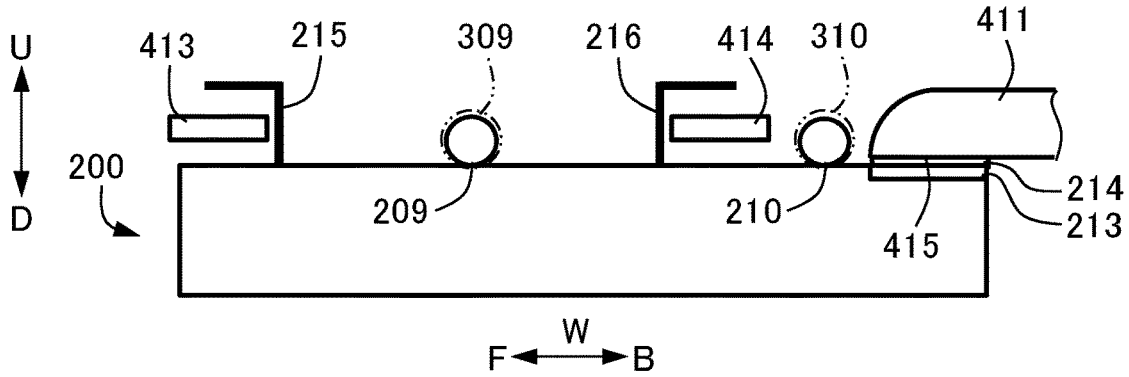
FIG. 14C is a schematic front view illustrating a state in which the sensor unit is being attached to the main-body frame of the second embodiment, and in which the first boss and the second boss are fit in the respective fitting hole portions.

Next, a procedure in which the sensor unit 200 of the present embodiment is attached to the main-body frame 400 will be described with reference to FIGS. 12 to 14C. FIGS. 12 and 14A illustrate a state in which the attachment of the sensor unit 200 is started. FIG. 14B illustrates a state in which the attachment of the sensor unit 200 is being performed. FIGS. 13 and 14C illustrate a state in which the attachment of the sensor unit 200 has been completed.

First, as illustrated in FIG. 12, the sensor unit 200 to which the potential sensor 101 (see FIG. 9A) and the electric board 102 are fixed is inserted in the main-body frame 400 in a direction from the right direction R side of the apparatus body 1*a* (see FIG. 1) to the left direction L side. As illustrated in FIGS. 12 and 14A, the sensor unit 200 is inserted in the main-body frame 400 while the first unit rail 215 and the second unit rail 216 of the sensor unit 200 are engaged with and guided by the first main-body rail 413 and the second main-body rail 414 of the main-body frame 400. Then the first boss 209 and the second boss 210 disposed on the duct body 203 are respectively fit in the first fitting hole portion 309 and the second fitting hole portion 310 disposed in the stay 306. In the present embodiment, since the first boss 209 is longer than the second boss 210, the first boss 209 is fit in the first fitting hole portion 309 earlier than the second boss 210 is fit in the second fitting hole portion 310.

As illustrated in FIG. 14A, before the first boss 209 and the second boss 210 are fit in the first fitting hole portion 309 and the second fitting hole portion 310, the joint opening portion 415 of the main-body-side duct 411 and the top surface of the seal member 214 are located at substantially the same height. Thus, if the first boss 209 and the second boss 210 are fit in the first fitting hole portion 309 and the second fitting hole portion 310 at the same time, the seal member 214 will slide with respect to the main-body-side duct 411 in the left direction L. In this time, a portion (in particular, an edge) of the seal member 214 may be caught by an edge of the main-body-side duct 411, and the seal member 214 may be peeled off from the periphery of the joint hole portion 213.

In the present embodiment, however, the first boss 209, the second unit rail 216, and the joint hole portion 213 are disposed in this order in the front-and-back direction W. Thus, as illustrated in FIG. 14B, the sensor unit 200 can be inclined for lowering the joint hole portion 213, within the clearance between the first unit rail 215 and the first main-body rail 413 and the clearance between the second unit rail 216 and the second main-body rail 414. In this manner, the sensor unit 200 is inserted in the main-body frame 400 in a state where the sensor unit 200 is inclined. In this state, the gap between the main-body-side duct 411 and the seal member 214 is made larger than the gap between the main-body-side duct 411 and the seal member 214 in the state illustrated in FIG. 14A. Consequently, the abutment pressure between the main-body-side duct 411 and the seal member 214, applied when the sensor unit 200 is inserted in the main-body frame in the left direction L, can be reduced, and the seal member 214 can be prevented from being peeled off.

In addition, since the first boss 209 is set longer than the second boss 210 in the present embodiment, the leading end portion of the first boss 209 is fit in the first fitting hole portion 309 earlier than the leading end portion of the second boss 210 is fit in the second fitting hole portion 310. When the leading end portion of the second boss 210 abuts against the stay 306, the leading end portion of the first boss 209 is fit in the first fitting hole portion 309, but the leading end portion of the second boss 210 is not fit in the second fitting hole portion 310. In this state, the sensor unit 200 is rotated in a rotational direction R2 such that a portion of the sensor unit 200 on the back direction B side is lifted. In this manner, the sensor unit 200 can pivot on the first boss 209. Thus, the joint hole portion 213 is moved closer to the joint opening portion 415 by pivoting the sensor unit 200, while the seal member 214 is pushed and contracted. With this operation, the sensor unit 200 is joined with the main-body-side duct 411 via the seal member 214 such that the joint hole portion 213 communicates with the joint opening portion 415.

Note that although the description has been made, in the present embodiment, for the case where the sensor unit 200 is inserted in the main-body frame 400 in a state where the sensor unit 200 is inclined as illustrated in FIG. 14B, and then the leading end portion of the first boss 209 is fit in the first fitting hole portion 309, the present disclosure is not limited to this. For example, the sensor unit 200 may be inserted in the main-body frame 400 horizontally as illustrated in FIG. 14A. In this case, after the leading end portion of the first boss 209 abuts against the stay 306, the sensor unit 200 is inclined and the leading end portion of the first boss 209 is fit in the first fitting hole portion 309.

After that, as illustrated in FIGS. 13 and 14C, the first boss 209 and the second boss 210 are fit in the first fitting hole portion 309 and the second fitting hole portion 310. With this operation, the potential sensor 101 is disposed between the charging unit 12 and the developing apparatus 14, at a predetermined position that faces the surface of the photosensitive drum 11. Then, the front boss 307 and the back boss 308 of the right plate 303 is fit in the positioning hole portion 107 and the rotation prevention hole portion 108 disposed in the fixing portion 104. The fixing portion 104 is then fastened to the right plate 303 with screws, and the attachment of the sensor unit 200 is completed.

As described above, in the image forming apparatus 1 of the present embodiment, the first boss 209 and the second boss 210 disposed on the duct body 203 are respectively fit in the first fitting hole portion 309 and the second fitting hole portion 310 disposed in the stay 306. Thus, when the sensor unit 200 is attached to the apparatus body 1*a*, the duct body 203 is positioned with respect to the stay 306, and the potential sensor 101 is disposed between the charging unit 12 and the developing apparatus 14, at a predetermined position that faces the surface of the photosensitive drum 11. Since the potential sensor 101 can be positioned at a position closer to the photosensitive drum 11, the measurement accuracy for the charge potential of the photosensitive drum 11 can be increased, compared to the case in which the potential sensor 101 is not positioned (thus, the positional accuracy is poor) and supported by a cantilever extending from the fixing portion 104. Thus, the occurrence of image defects can be suppressed.

As described above, in the image forming apparatus 1 of the present embodiment, the sensor unit 200 includes the first unit rail 215 and the second unit rail 216, and the main-body frame 400 includes the first main-body rail 413 and the second main-body rail 414. Thus, when the sensor unit 200 is attached to the main-body frame 400, the first boss 209 and the second boss 210 of the duct body 203 can be easily positioned at and fit in the first fitting hole portion 309 and the second fitting hole portion 310 of the stay 306 by the first main-body rail 413 and the second main-body rail 414 guiding the first unit rail 215 and the second unit rail 216. Thus, the workability for replacing the sensor unit 200 can be increased.

In addition, in the image forming apparatus 1 of the present embodiment, since the duct body 203, on which the potential sensor 101 is mounted, forms one portion of the air duct 217, ozone that exists around the charging unit 12 can be drawn and discharged to the back direction B side of the apparatus body 1*a*. With this operation, the occurrence of image defects, such as image deletion, can be suppressed.

As described above, the present disclosure can suppress the occurrence of image defects.

Note that the description has been made for the image forming apparatus 1 of the present embodiment in which the rail members are disposed on both of the sensor unit 200 and the main-body frame 400, the present disclosure is not limited to this. For example, rail members may be disposed on one of the sensor unit 200 and the main-body frame 400, and an engaging portion, such as a projection or a flange, that is guided by the rail members may be disposed on the other.

In addition, although the description has been made for the image forming apparatus 1 of the present embodiment in which the rail members are disposed on both of the sensor unit 200 and the main-body frame 400, the present disclosure is not limited to this. For example, the rail members may not be disposed on both of the sensor unit 200 and the main-body frame 400, and the first boss 209 may be directly fit in the first fitting hole portion 309. Also in this case, it is possible that the leading end portion of the first boss 209 is fit in the first fitting hole portion 309 earlier than the leading end portion of the second boss 210 is fit in the second fitting hole portion 310, then a portion of the sensor unit 200 on the back direction B side is lifted (rotated) in a state where the second boss 210 is not fit in the second fitting hole portion 310, and then the joint hole portion 213 is positioned so as to communicate with the joint opening portion 415.

In addition, although the description has been made for the image forming apparatus 1 of the present embodiment in which the first boss 209 is longer than the second boss 210, the present disclosure is not limited to this. For example, the first boss 209 may have the same length as that of the second boss 210, as in the first embodiment.

In addition, although the description has been made for the image forming apparatus 1 of the present embodiment in which the first unit rail 215, the first boss 209, the second unit rail 216, the second boss 210, and the joint hole portion 213 are disposed in this order in a direction from the front direction F side to the back direction B side, the present disclosure is not limited to this. For example, if the main-body-side duct 411 is disposed on the front direction F side, the first unit rail 215, the first boss 209, the second unit rail 216, the second boss 210, and the joint hole portion 213 are disposed in this order in a direction from the back direction B side to the front direction F side. In addition, whether the sensor unit 200 can be inclined, when the sensor unit 200 is attached to the main-body frame 400, so that the seal member 214 does not interfere with the main-body-side duct 411, and whether the sensor unit 200 can be pivoted in a state where the leading end portion of the first boss 209 is fit in the first fitting hole portion 309 depend on the play between the first unit rail 215 and the first main-body rail 413, and between the second unit rail 216 and the second main-body rail 414. Thus, if the sensor unit 200 can be inclined and pivoted as described above, the first unit rail 215, the first boss 209, the second unit rail 216, the second boss 210, and the joint hole portion 213 may not be disposed in this order.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-087778, filed May 20, 2020 which is hereby incorporated by reference herein in its entirety.

What is claimed is:

1. An image forming apparatus comprising:

a rotatable photosensitive member;

a charging unit configured to charge the photosensitive member;

a developing unit configured to develop an electrostatic latent image formed on the photosensitive member by using toner;

a support frame supporting the photosensitive member; and a sensor unit detachably attached to the support frame in a direction that intersects a rotation-axis direction of the photosensitive member and comprising:

a potential sensor configured to measure a potential of the photosensitive member;

a support portion supporting the potential sensor at an area from the charging unit to the developing unit in a rotational direction of the photosensitive member;

a fixing portion fixed to the support frame at a position opposite to the potential sensor with respect to the photosensitive member when viewed from the rotation-axis direction of the photosensitive member;

an electric board connected to the potential sensor and fixed to the fixing portion; and a linking portion linking the support portion and the fixing portion, wherein the support portion is positioned with respect to the support frame at a position downstream from the fixing portion in an attachment direction of the sensor unit.

2. The image forming apparatus according to claim 1, wherein the support frame comprises a guiding portion extending in the direction that intersects the rotation-axis direction of the photosensitive member, and wherein the sensor unit comprises a guided portion configured to be guided by the guiding portion when the sensor unit is attached to the support frame.

3. The image forming apparatus according to claim 1, wherein the support portion comprises a boss whose center axis extends along an attachment-and-detachment direction in which the sensor unit is attached to or detached from the support frame, wherein the support frame comprises a fitting hole portion in which the boss is fit, and wherein when the sensor unit is attached to the support frame, the potential sensor is positioned with respect to the support frame by the boss fitting in the fitting hole portion.

4. The image forming apparatus according to claim 1, wherein the support portion forms an air duct configured to draw air that exists around the photosensitive member.

5. The image forming apparatus according to claim 4, wherein the support portion comprises a first boss and a second boss whose center axes extend along an attachment-and-detachment direction in which the sensor unit is attached to or detached from the support frame, wherein the first boss is disposed at a position different from a position of the second boss in a direction that intersects the rotational direction of the photosensitive member, wherein the support frame comprises a first fitting hole portion and a second fitting hole portion whose center axes extend along the attachment-and-detachment direction, wherein the first fitting hole portion is disposed at a position at which the first boss is fit in the first fitting hole portion when the sensor unit is attached to the support frame, wherein the second fitting hole portion is disposed at a position at which the second boss is fit in the second fitting hole portion when the sensor unit is attached to the support frame, wherein the air duct comprises a second communicating opening portion configured to communicate with a first communicating opening portion of a main-body-side duct provided at the support frame, wherein the first boss has a shape longer than that of the second boss in the attachment-and-detachment direction, and wherein the sensor unit and the support frame are configured such that when the sensor unit is attached to the support frame, a leading end portion of the first boss is fit in the first fitting hole portion, the sensor unit is pivoted on the first boss in a state where the second boss is not fit in the second fitting hole portion, and the second communicating opening portion is allowed to communicate with the first communicating opening portion by pivoting the sensor unit.

6. The image forming apparatus according to claim 5, wherein the first boss, the second boss, and the second communicating opening portion are disposed in this order in the direction that intersects the rotational direction of the photosensitive member.

7. The image forming apparatus according to claim 5, wherein the support frame comprises a first guiding portion, and a second guiding portion disposed at a position different from a position of the first guiding portion in the direction that intersects the rotational direction of the photosensitive member, wherein the sensor unit comprises a first guided portion and a second guided portion, the first guided portion being guided by the first guiding portion and the second guided portion being guided by the second guiding portion such that the first boss and the second boss are positioned with respect to the first fitting hole portion and the second fitting hole portion when the sensor unit is attached to the support frame, and wherein the first guided portion, the first boss, the second guided portion, the second boss, and the second communicating opening portion are disposed in this order in the direction that intersects the rotational direction of the photosensitive member.

8. The image forming apparatus according to claim 1, further comprising a cleaning portion disposed downstream of a transfer portion in the rotational direction of the photosensitive member, and configured to abut against the photosensitive member and clean a surface of the photosensitive member, wherein when viewed from the rotation-axis direction of the photosensitive member, the electric board is disposed opposite to the photosensitive member with respect to the cleaning portion.

* * * * *